US009961437B2

(12) United States Patent
McLaughlin et al.

(10) Patent No.: US 9,961,437 B2
(45) Date of Patent: May 1, 2018

(54) DOME SHAPED MICROPHONE ARRAY WITH CIRCULARLY DISTRIBUTED MICROPHONES

(71) Applicant: Signal Essence, LLC, Mountain View, CA (US)

(72) Inventors: Hugh Joseph McLaughlin, Mountain View, CA (US); Caleb Henry Crome, San Jose, CA (US)

(73) Assignee: Signal Essence, LLC, Mountain View, CA (US)

( * ) Notice: Subject to any disclaimer, the term of this patent is extended or adjusted under 35 U.S.C. 154(b) by 0 days. days.

(21) Appl. No.: 15/286,944

(22) Filed: Oct. 6, 2016

(65) Prior Publication Data

US 2017/0105066 A1 Apr. 13, 2017

Related U.S. Application Data

(60) Provisional application No. 62/239,128, filed on Oct. 8, 2015.

(51) Int. Cl.

| | |
|---|---|
| ***H04R 3/00*** | (2006.01) |
| ***H04R 1/40*** | (2006.01) |
| ***H04R 1/36*** | (2006.01) |
| ***H04R 1/04*** | (2006.01) |

(52) U.S. Cl.

CPC ..... *H04R 1/406* (2013.01); *H04R 1/04* (2013.01); *H04R 1/36* (2013.01); *H04R 3/005* (2013.01); *H04R 2430/23* (2013.01); *H04R 2430/25* (2013.01)

(58) Field of Classification Search

CPC ..... H04R 2201/405; H04R 29/005; H04R 2430/23; H04R 2430/25; H04R 1/04; H04R 1/36; H04R 1/406; H04R 3/005

USPC ..... 381/56, 58, 91, 92, 186, 335

See application file for complete search history.

(56) References Cited

U.S. PATENT DOCUMENTS

| | | | | |
|---|---|---|---|---|
| 6,016,346 | A * | 1/2000 | Rittmueller | H04M 1/6033 379/420.02 |
| 6,041,127 | A * | 3/2000 | Elko | H04R 3/005 381/66 |
| 7,840,013 | B2 * | 11/2010 | Dedieu | H04R 1/406 381/122 |
| 7,970,151 | B2 | 6/2011 | Oxford et al. | |
| 9,253,566 | B1 * | 2/2016 | Taenzer | H04R 3/005 |
| 2006/0204023 | A1 * | 9/2006 | Stinson | H04R 1/406 381/122 |
| 2006/0227963 | A1 * | 10/2006 | Bernard | H04M 1/6033 379/388.01 |

(Continued)

*Primary Examiner* — William A Jerez Lora

(74) *Attorney, Agent, or Firm* — Fountainhead Law Group P.C.

(57) ABSTRACT

A sound sensing device may include a housing having a dome-shaped shell and a baseplate. The housing may have a symmetrically shaped perimeter. The dome-shaped shell may have an arcuate cross section characterized by tangent lines that monotonically increase in slope from a top of the dome-shaped shell toward a bottom of the dome-shaped shell. At least three sound ports may be provided between an interior volume of the housing and an exterior surrounding of the housing, and disposed symmetrically and peripherally about the perimeter of the housing. The sound ports may be located at most 1 cm above the support surface.

30 Claims, 37 Drawing Sheets

(56) References Cited

U.S. PATENT DOCUMENTS

| | | | | |
|---|---|---|---|---|
| 2007/0127759 | A1* | 6/2007 | Zhang | H04R 1/342<br>381/338 |
| 2009/0002476 | A1* | 1/2009 | Cutler | H04N 7/142<br>348/14.01 |
| 2009/0159543 | A1* | 6/2009 | Burgess | A47B 49/00<br>211/144 |
| 2014/0161295 | A1* | 6/2014 | Huang | H04R 1/406<br>381/357 |
| 2014/0185814 | A1* | 7/2014 | Cutler | H04R 5/04<br>381/26 |
| 2014/0226836 | A1* | 8/2014 | Miyatake | H04R 1/1083<br>381/94.1 |
| 2015/0213811 | A1* | 7/2015 | Elko | H04R 3/005<br>381/92 |
| 2015/0237431 | A1* | 8/2015 | Jeziorek | H04R 1/086<br>381/361 |
| 2015/0304786 | A1* | 10/2015 | Partio | H04R 25/305<br>381/58 |
| 2016/0007114 | A1* | 1/2016 | Frater | H04R 27/00<br>381/71.7 |
| 2017/0134545 | A1* | 5/2017 | Lee | H04M 1/026 |

* cited by examiner

90°
60°
30°
0°
330°
300°
270°
240°
210°
180°
150°
120°

Horizontal Polar Response at 3600 Hz

Vertical Polar Response at 3600 Hz

Typical Frequency Response of a Single Microphone

Directivity Index – Six Microphone Hybrid Differential Beam With Dome-Shape Acoustics

DOME SHAPED MICROPHONE ARRAY WITH CIRCULARLY DISTRIBUTED MICROPHONES

CROSS REFERENCE TO RELATED APPLICATIONS

Pursuant to 35 U.S.C. § 119(e), this application is entitled to and claims the benefit of the filing date of U.S. Provisional App. No. 62/239,128 filed Oct. 8, 2015, the content of which is incorporated herein by reference in its entirety for all purposes.

TECHNICAL FIELD

The present disclosure is generally directed to voice capture devices that are used to capture human voice for the purpose of either a speakerphone or for speech recognition.

BACKGROUND

It is generally recognized that most speakerphones provide inferior quality voice to people who are listening at the far end of a conversation. The listeners may experience impairments such as a cave-like sound caused by reverberation, an annoying amount of background noise such as equipment noise (e.g., cell phones ringing, air conditioners, copying machines, and so on), interfering voices from unintended talkers, and the like. In the case of a device that performs speech recognition, the error rate may be caused by reverberation, interfering sounds, and persistent noise. The speech recognition accuracy can be improved by reducing reverberation and reducing or eliminating sounds from interfering talkers.

To achieve performance improvements, it is common to use several microphones in a cooperative way to improve the speech signal. A configuration that uses several microphones is called a microphone array. Microphone arrays may include a number of geometrically arranged microphone sensors for receiving sound signals (such as speech signals) and converting the sound signals to electrical signals. The electrical signals may be digitized by analog-to-digital converters (ADCs) to converting the analog output (sound signals) of the microphone sensor into digital signals, which may be further processed by software that runs on a processor (such as a microprocessor or digital signal processor). Compared with a single microphone, the multiple sound signals received by a microphone array allow for processing such as noise reduction, speech enhancement, sound source separation, de-reverberation, spatial sound recording, and source localization and tracking, and so on. The processed digital signals may be packetized for transmission over communication channels or converted back to analog signals using a digital-to-analog converter (DAC), or may be provided to a speech recognition algorithm to detect human speech. Microphone arrays are typically configured for beamforming, or directional sound signal reception.

Additive microphone arrays are a configuration of microphones that can achieve signal enhancement and noise suppression based on delay-and-sum principles. In some configurations, there may not be a need for a delay element resulting in an additive-only type of processing, and so the phrase "delay and sum" may be used interchangeably with the term "additive." To achieve better acoustic noise suppression, additive microphone arrays may include a large inter-sensor distance. Additive microphone arrays can be effective when the spacing between the microphones is approximately one half of the wavelength of the signal of interest. Unfortunately, speech is very broadband, spanning many octaves. To be effective at low frequencies the microphone elements have to be spread out so far that the device would be bulky. At high frequencies, the main beam may be very narrow and there will be a lot of strong side lobes. Consequently, additive microphone configurations are limited to a small range of frequencies. An advantage of an additive microphone array, however, is that they are simple to implement and the mere act of adding the microphone signals together reduces the self-noise (sensor noise) of the microphone elements, where the self-noise is caused by uncorrelated electrical noise that emanates from each microphone element.

In contrast, differential microphone arrays (DMAs) allow for small inter-microphone distance, and may be made very compact. DMAs include an array of microphone sensors that are responsive to the spatial derivatives of the acoustic pressure field. A disadvantage of DMAs is that they are sensitive to electrical self-noise that comes from the microphone element. Unlike environmental noise, the microphone sensor noise is inherent to the microphone sensors and therefore is present even in a soundproof environment such as a soundproof booth. In addition, DMAs usually perform equalization to compensate for the fact that taking the difference of the microphone sensors distorts the frequency response, which needs to be inverted to result in a flat frequency response. The equalization is only perfect if the direction of the talker is exactly in line with the intended direction of the DMA beam. As used herein, the word "equalization" may be used interchangeably with "compensator."

Several microphone array systems can pick up sound in all directions. For example, Polycom® Soundstation® speakerphones have been designed with directional microphones generally located in one of three legs of the Polycom® speakerphone device. In another instance, the LifeSize® phone was a conferencing phone that used twelve omni-directional microphones arranged around the circular perimeter of the circular device. In yet another instance, the Amazon Echo® product used a seven microphone array with six microphones arranged in a circle of diameter of 3.25 inches (82 mm) with one microphone located in the center with all the microphones located on top of the cylindrical device.

In the case of speakerphone devices that use directional microphones, such as the Polycom® Soundstation® products, the devices can be bulky because the directional microphones require space around each of the uni-directional microphones to create a sound field that will allow the directional microphones to operate directionally. The directional microphones, also called pressure gradient microphones, require that the front and rear ports of the microphone detect sound waves that have not been distorted by nearby surfaces.

In each of these speakerphone devices, a search is made to determine the direction of the active talker. A decision is made as to which way to point. Either a directional microphone is selected or a beam is formed to pick up the sound in the active direction. This is how sound is picked up with the least amount of background noise or reverberation. It is not possible to pick up sound in all directions at the same time without letting in more noise and reverberation. In the case where the direction-finding algorithm cannot make an absolute decision on which direction to pick up sound, then the algorithm may compromise and either pick up from two microphones, in the case of a speakerphone with uni-directional microphones, or it may cast a beam with a broad lobe if a beam is formed using several microphones. In the case where there is no determination at all about the direction, then it is possible for the direction-finding algorithm to fall back and use merely a single microphone on a temporary basis until sound arrives in a definitive direction.

Instead of using directional microphones, it is possible to use omni-directional microphones in a microphone array to achieve directionality. Omni-directional microphones are identically the same as pressure microphones. That is, they only sense sound pressure and not the gradient of sound pressure. A challenge is that the range of frequencies necessary to represent voice is very large, spanning approximately six octaves. For modern speech communication and speech recognition, it is often desirable to be able to pick up sound between 100 Hz to 7000 Hz. A problem for microphone arrays is that this is a very large range of wavelengths to support. At 100 Hz, the wavelength is approximately 3.4 meters. At 7000 Hz, the wavelength is approximately 0.049 meters, a ratio of 70:1. As noted above, a delay and sum array configuration is not able to support that ratio without a huge number of widely spaced microphones. Consequently, it is necessary to use a differential array. Differential arrays work by measuring the gradient of sound, and hence they measure the rate of change of sound pressure. To present a flat frequency response, it is necessary to equalize (or compensate) the result of the difference, which itself can create a high level of noise especially at the low frequencies. To combat the noise, it is possible to move the microphones further apart to decrease the noise, but this limits the ability of the differential array to work at high frequencies.

Configurations of basic two-microphone arrays for beamforming include: a broadside delay and sum array ("broadside array") shown in FIG. 1; an end-fire delay and sum array ("end-fire array") shown in FIG. 2; and a differential cardioid array ("differential array") shown in FIG. 3.

Referring to FIG. 1, a broadside array can provide directivity for a narrow range of frequencies of the desired speech. The output of each microphone sensor is weighted by ½ and summed. The ½ weighting preserves the original amplitude of the incoming sound at the output of the summer. A broadside array configuration can achieve significant directionality (a null to 90°) when the spacing between the microphones equals one half the wavelength of the frequency of the sound. The formula for this frequency is: $f_b=c/(2\times d)$, where c is the speed of sound and d is the distance between the microphones. The overall directivity at this frequency is only about 4 dB at the frequency $f_b$. Above this frequency, there may be more directivity, but at a cost of very significant side lobes. This array is generally useful between approximately $0.8\times f_b$ and $1.5\times f_b$.

Referring to FIG. 2, an end-fire array can provide better directivity than the broadside array, and can be more effective at lower frequencies of the desired speech. The polar response of the end-fire array resembles the familiar cardioid pattern when the distance between the microphones is one fourth of the wavelength. The formula for this frequency is: $f_e=c/(4\times d)$, where c is the speed of sound and d is the distance between the microphones. Like the broadside array, an end-fire array is generally useful between a limited range, approximately $0.8\times f_e$ and $1.5\times f_e$.

Referring to FIG. 3A, a differential array can potentially operate over the whole frequency range if the individual microphones are close together. Using two microphones to make a cardioid polar response, a differential array can produce a nearly cardioid response up to $f_d=c/(4\times d)$, where c is the speed of sound and d is the distance between microphones. Above this frequency, the cardioid shape starts to bulge out in the sideways directions relative to the direction of the main beam. In addition, it may become necessary to add more gain to the compensation; e.g., via a compensating filter. For example, below $0.5\times f_d$, it may be necessary to add gain to compensate for the fact that the differential array is a differentiator, so it needs to be compensated by a compensating filter that resembles an integrator. The compensating filter may be a gain and phase equalizer with a slope of 6 dB per octave as the frequency approaches 0 Hz. This filter can dramatically raise the self-noise at low frequencies. The level of noise may be unacceptable. In order to lower the noise floor, one may use microphones that have lower self-noise, or employ a design that spreads the microphones farther apart.

Referring to FIG. 3B, a generalized microphone array can be utilized which can make any style of beam by adjusting the coefficients and the delays. A goal in making a beam is to make a beam with a reasonable main lobe, low sidelobes, low self-noise, and low sensitivity to variations in microphone sensitivity that is effective across a wide range of frequencies. This may be accomplished by designing a beam that is a hybrid of additive beam and differential beams.

Since there is no perfect beamforming technique, some systems may select a different beamforming technique for different frequencies; e.g., broadside, end-fire, differential beams, or hybrids of these techniques. In U.S. Pat. No. 7,970,151, for example, the disclosure uses a large number of omni-directional microphones, twelve. The disclosure describes the use of an additive array at the high frequencies and a differential microphone array at low frequencies. A disadvantage is that the geometry may force the beam created by the additive array to be very narrow with significant side lobes. The narrow beam would make the system very fragile when the talker is moving or if the direction-finding was not accurate. The number of microphones, twelve, can add significant cost to the device.

These and other issues are addressed by embodiments of the present disclosure, individually and collectively.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. In the discussion to follow, in conjunction with the drawings, make apparent to those of skill in the art how embodiments in accordance with the present disclosure may be practiced. In the accompanying drawings.

DETAILED DESCRIPTION

In the following description, for purposes of explanation, numerous examples and specific details are set forth in order to provide a thorough understanding of the present disclosure. It will be evident, however, to one skilled in the art that the present disclosure as defined by the claims may include some or all of the features in these examples alone or in combination with other features described below, and may further include modifications and equivalents of the features and concepts described herein.

The present disclosure teaches an approach to achieve reasonable width beams and low side lobes using a reasonable number of microphones by utilizing the shape of the device. The present disclosure teaches a method to reduce unwanted sound to achieve high quality speech transmission using microphones mounted strategically and supported by a spatial filtering algorithm to produce a signal that is an accurate representation of the desired talker. This signal can either be transmitted to the network for a far-end human listener, or the signal can be provided to a speech recognition program to convert the speech signal into words.

Figure 1:
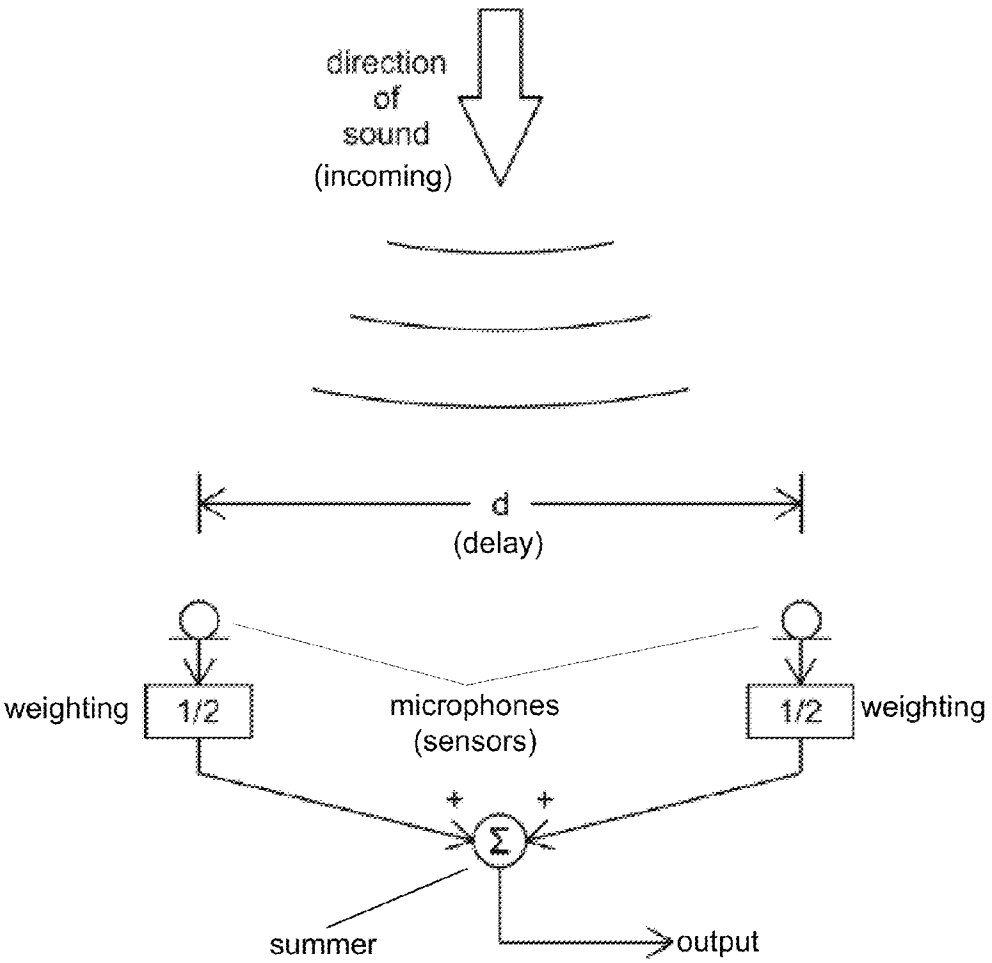
FIG. 1 is a signal diagram of a two-microphone broadside delay and sum array.
Figure 2:
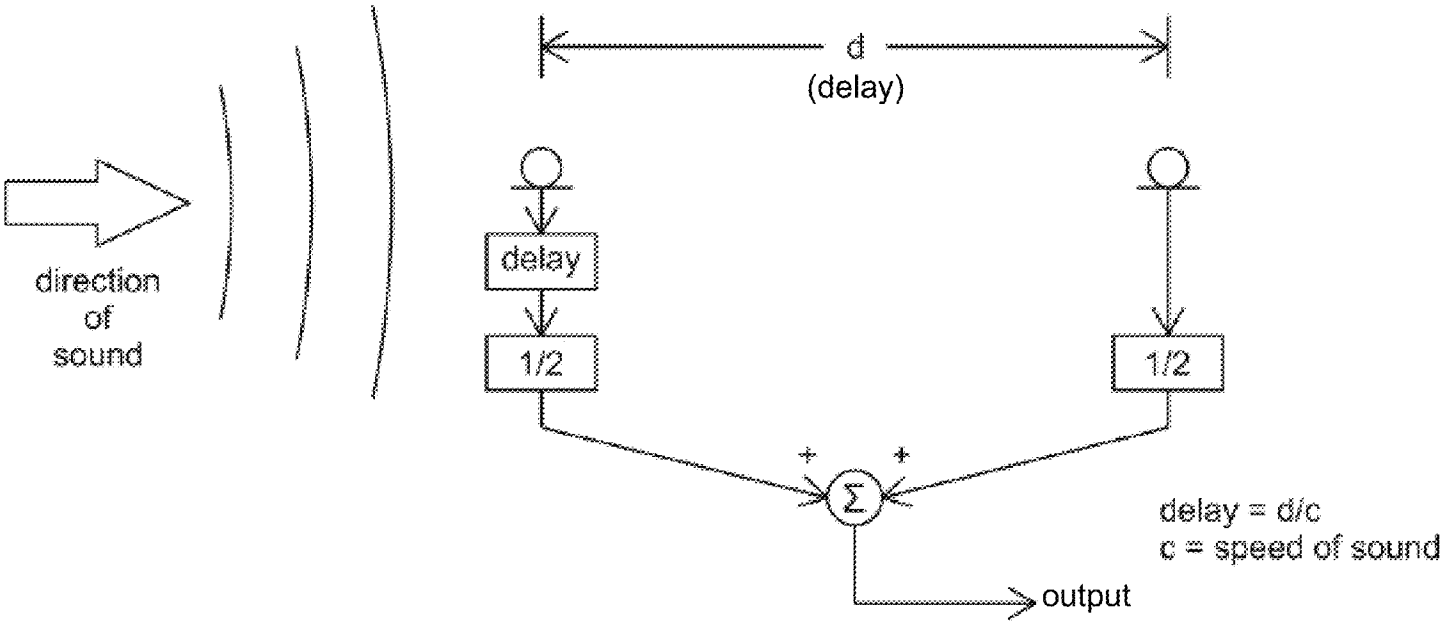
FIG. 2 is a signal diagram of a two-microphone end-fire delay and sum array.
Figure 3A:
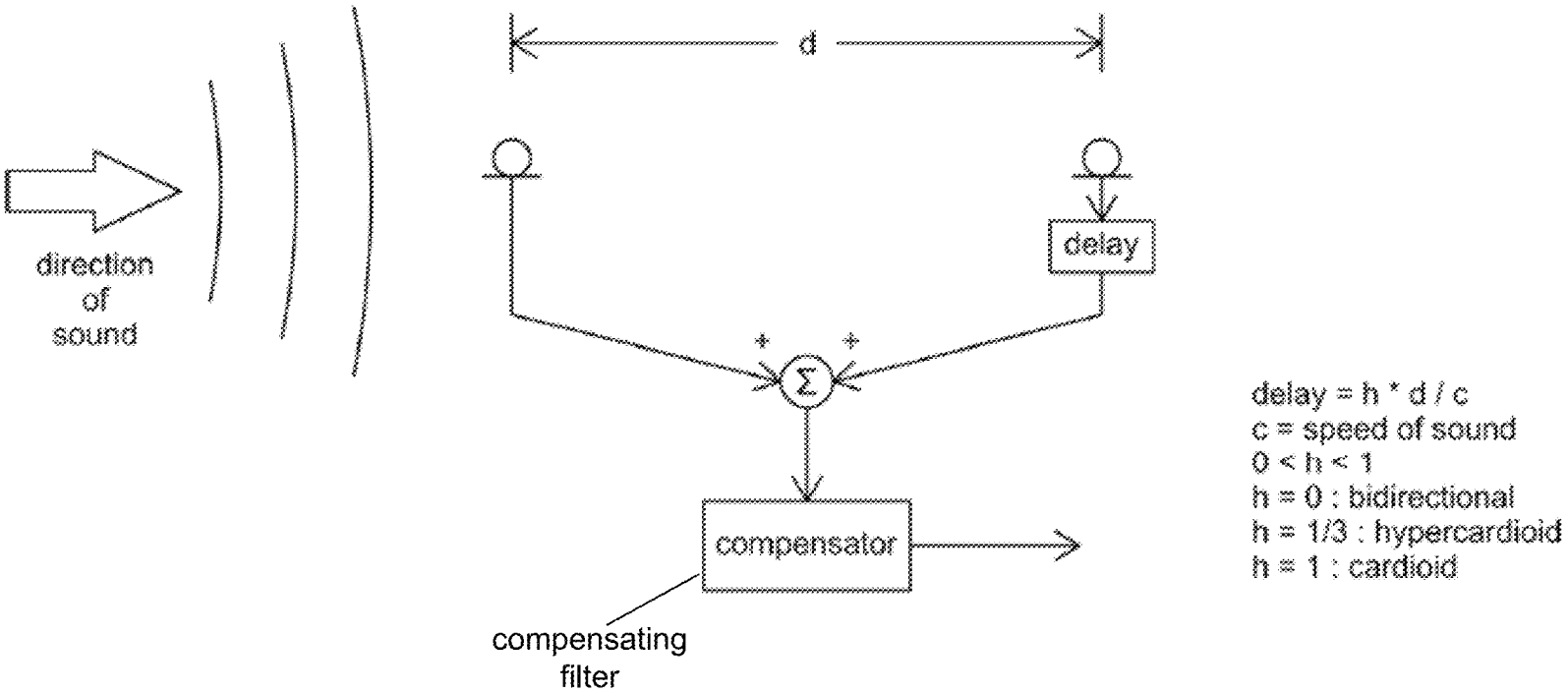
FIG. 3A is a signal diagram of a two-microphone differential cardioid array.
Figure 3B:
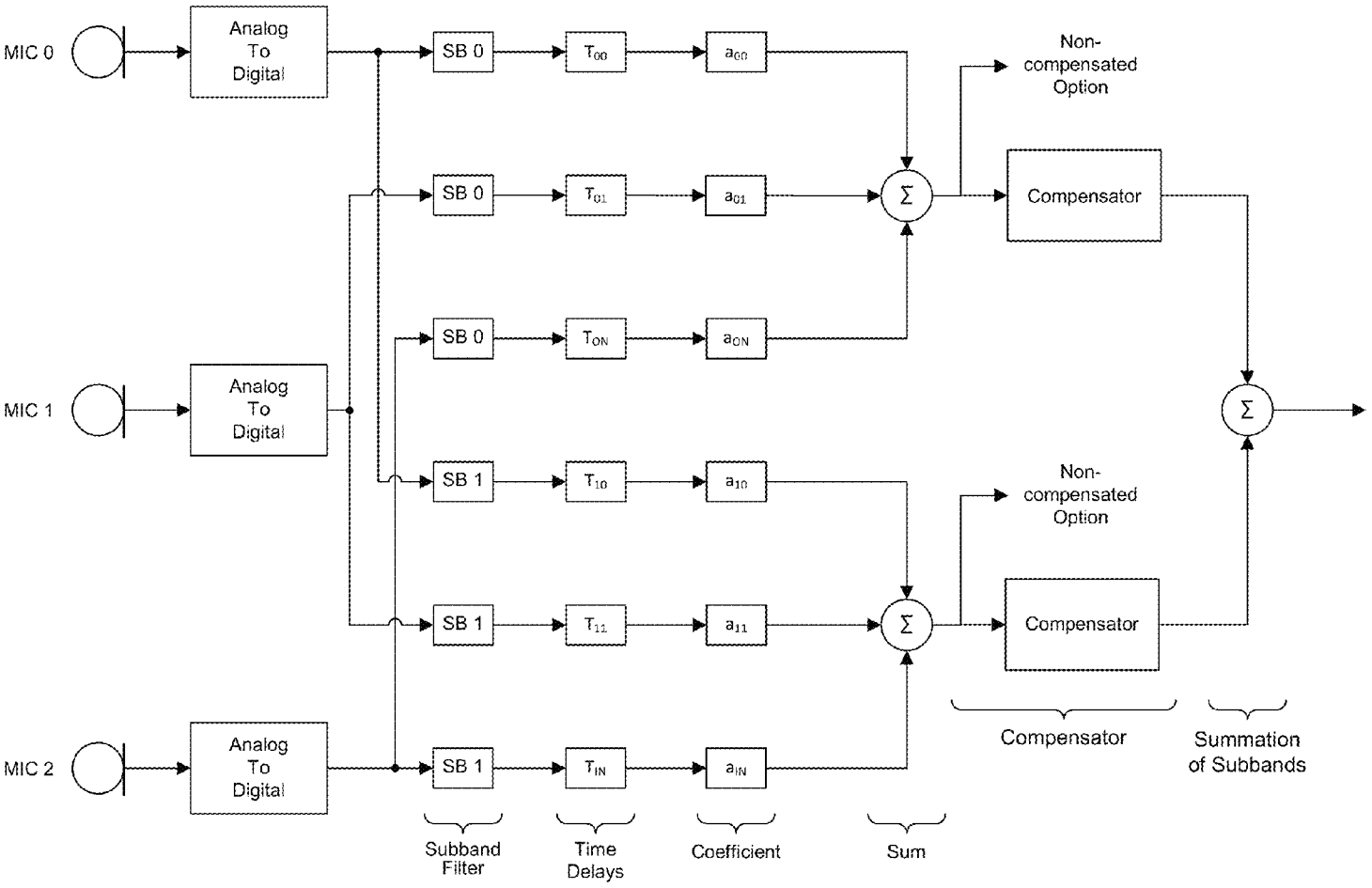
FIG. 3B is a signal diagram showing a general form of a subband beamformer.
Figure 4:
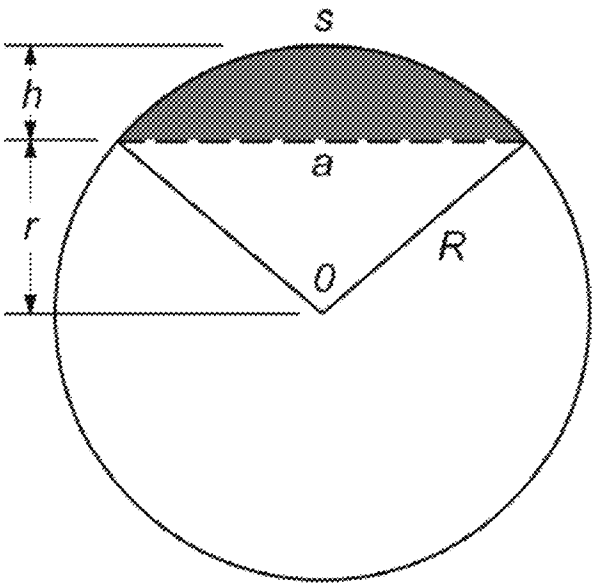
FIG. 4 shows a definition of a circular segment.

Embodiments in accordance with the present disclosure generally provide a housing having a dome-shaped shell. The housing contains a microphone array that is configured to capture sound, and utilizes the shape of the housing to enhance the sound. As used herein, the word "dome" is used to describe a shape having a cross section that is approximately a "circular segment." Merely as an illustration, FIG. 4 shows a circular segment (shaded) that may be defined as a portion of a disk whose upper boundary is an (circular) arc and whose lower boundary is a chord making a central angle $\theta<180°$. The entire wedge-shaped area may be referred to as a circular sector.

Embodiments in accordance with the present disclosure can utilize the shape of the housing to enhance the directivity and minimize the number of microphones needed, while providing well-behaved beams that have reasonable width main lobes while minimizing side lobes. Instead of ignoring the shape of the housing, embodiments in accordance with the present disclosure utilize the shape of the housing to help improve the performance.

Figure 5:
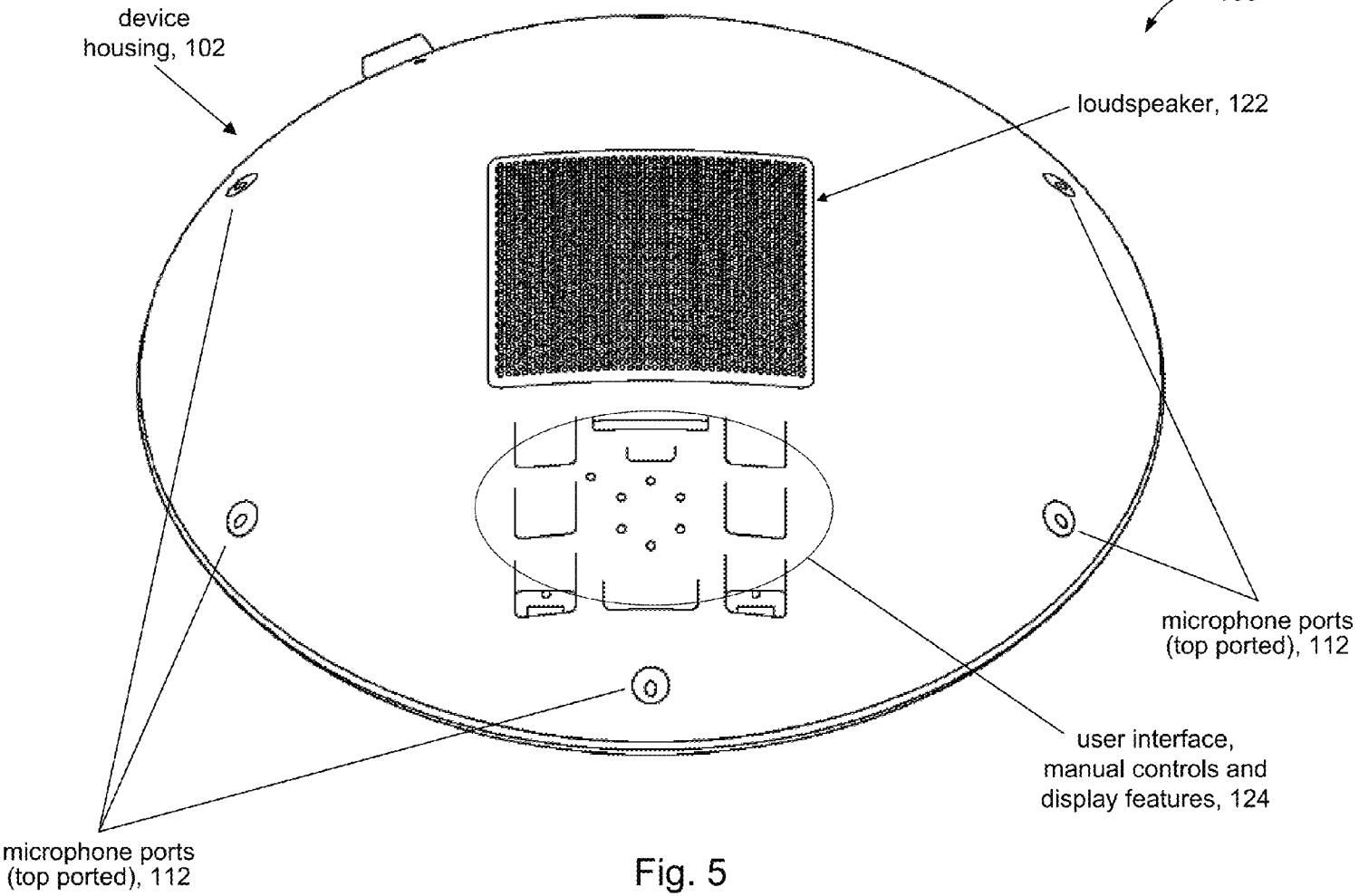
FIG. 5 is a perspective view of an embodiment of the device with microphones ported upward.
Figure 6:
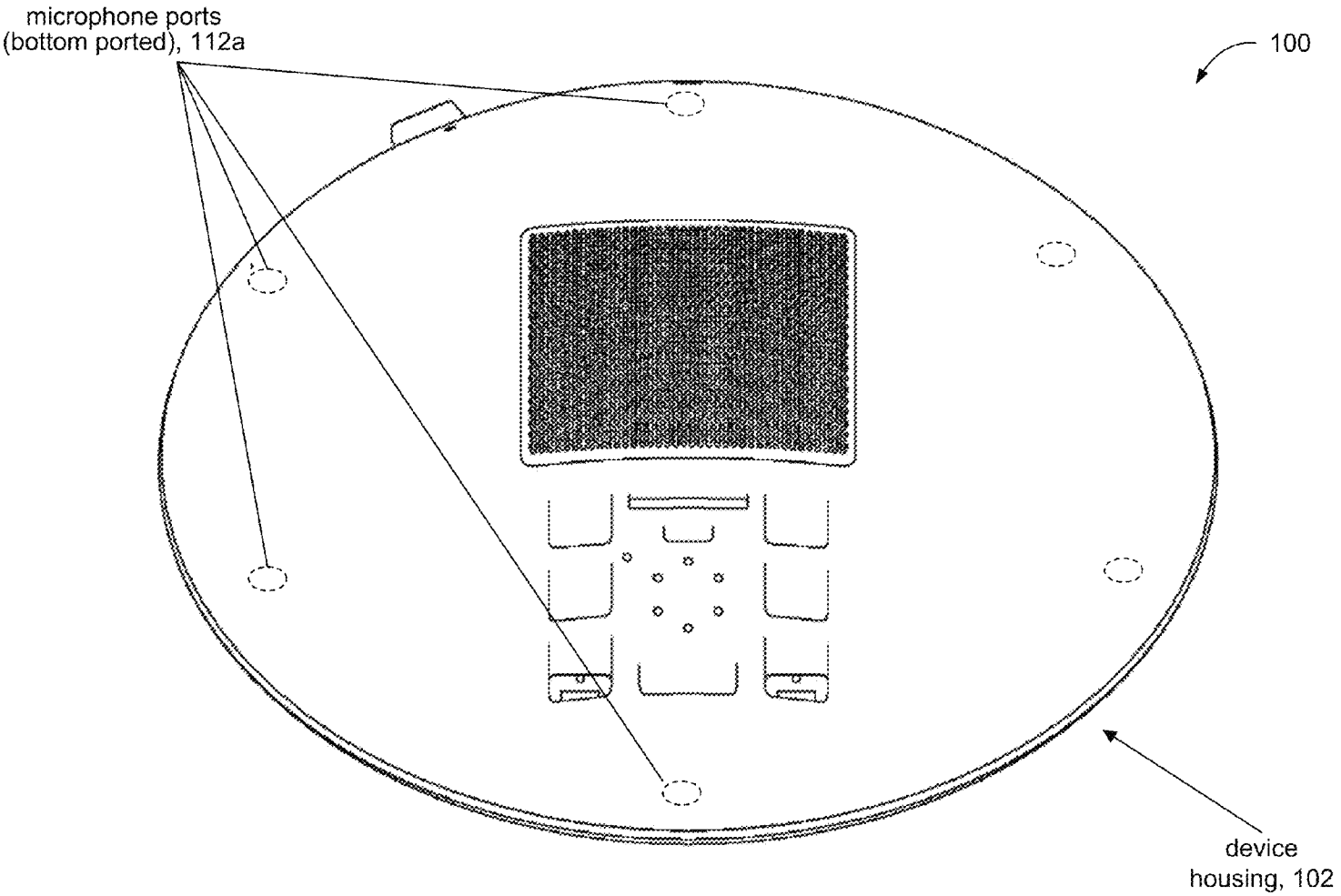
FIG. 6 is a perspective view of an embodiment of the device with microphones ported downward.

FIG. 5 shows a perspective view of a sound sensing device 100 in accordance with the present disclosure. In some embodiments the device 100 may have an overall dome-like shape. The device 100 may include a device housing 102 to house various components of the device 100 (e.g., electronics, control buttons, etc.). In some embodiments, the housing 102 may include a plurality of microphone ports (sound ports, openings) 112 arranged peripherally about a perimeter of the housing 102. Microphones (not shown) may be contained in the housing 102 and arranged near respective microphone ports 112 to receive acoustic signals (sound) via the respective microphone ports 112. In some embodiments (e.g., FIG. 5), the microphone ports 112 may be facing upward so that the microphones face upward (top-ported). In other embodiments (e.g., FIG. 6), the microphones (not shown) may be located beneath the housing 102 with microphone ports 112*a* facing downward so that the microphones face downward (bottom-ported).

Figure 7:
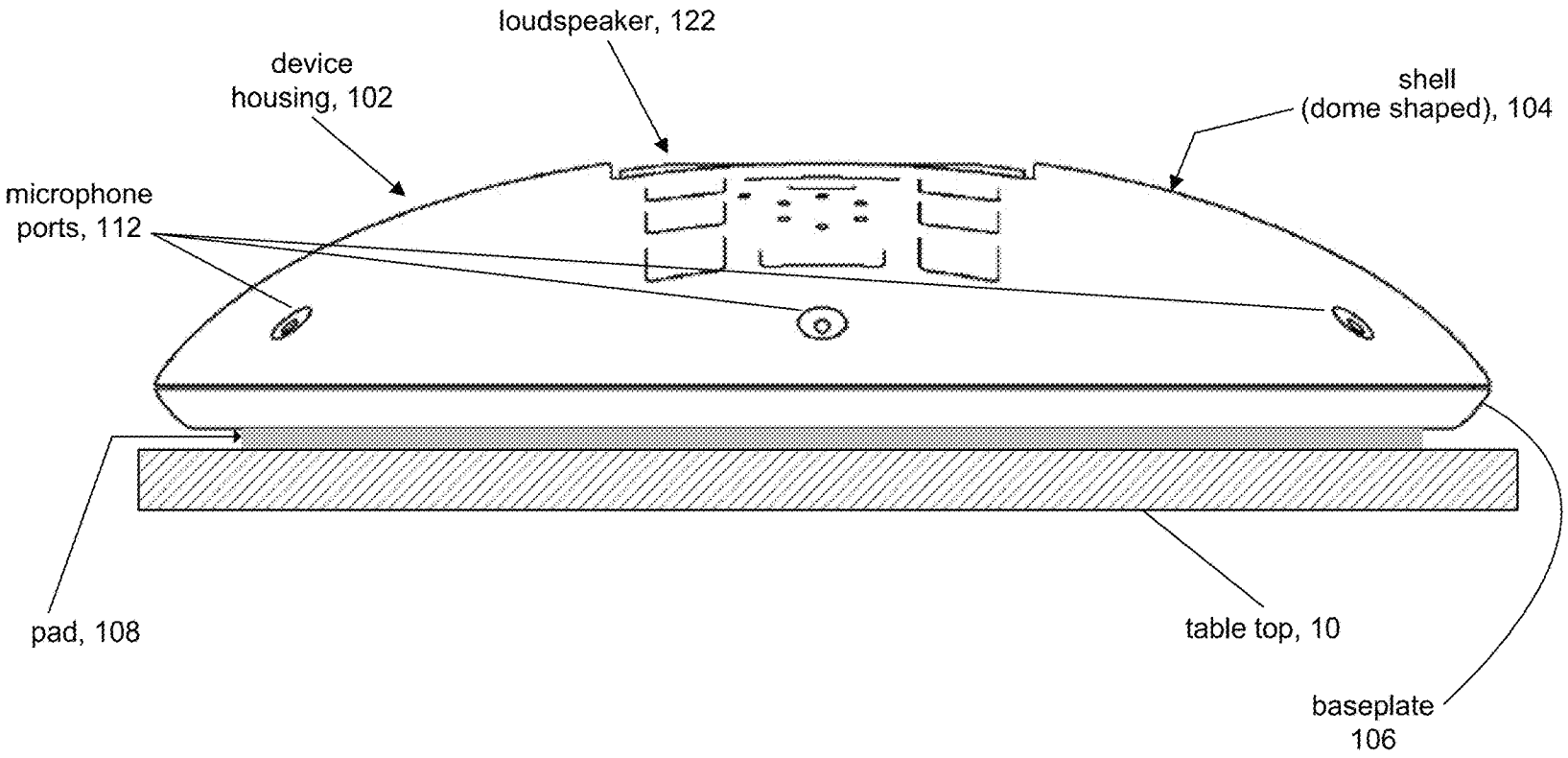
FIGS. 7 and 7A show plan views of the device with microphones ported upward.
Figure 7A:
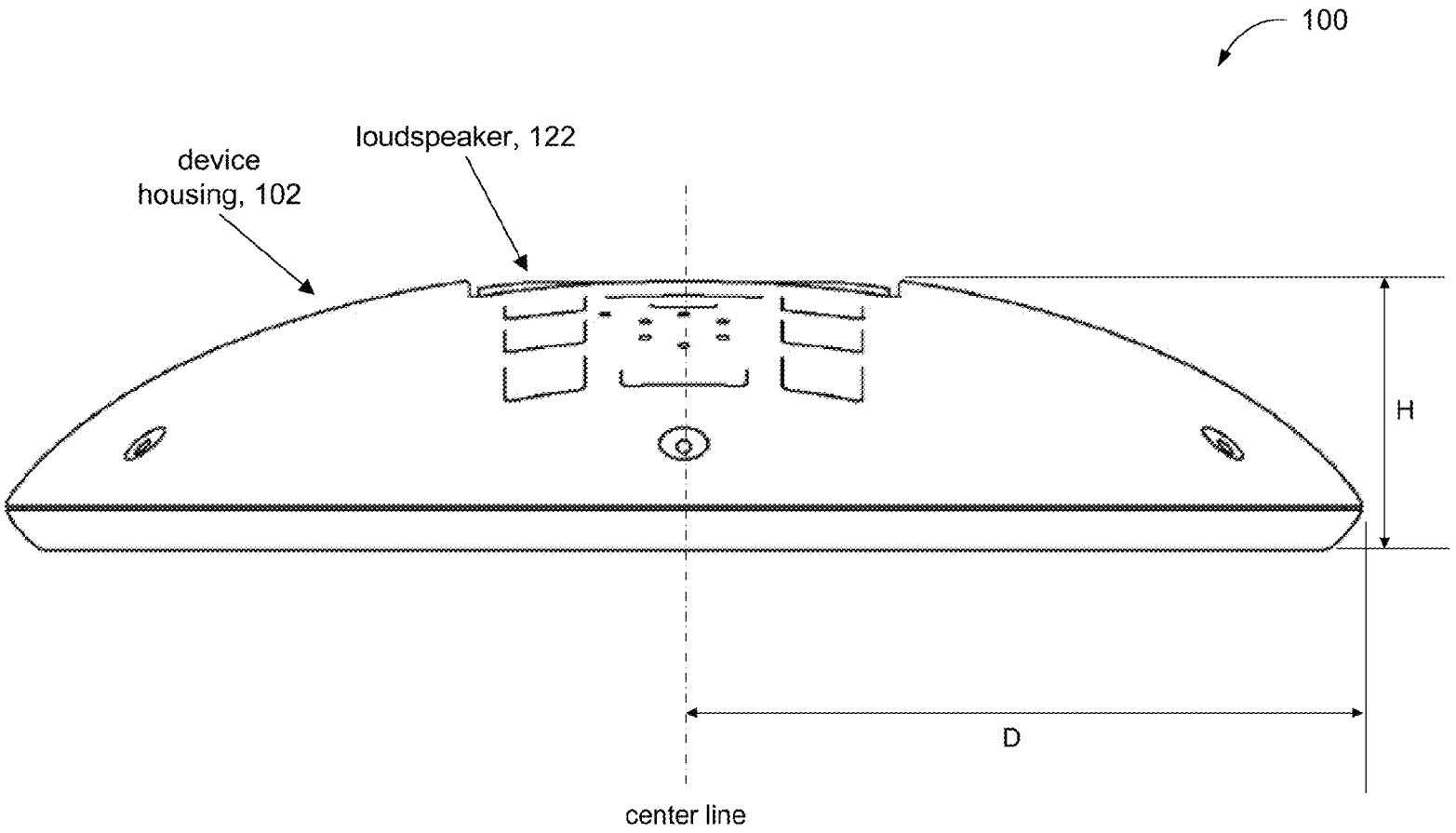

FIG. 7 is a table-level front-facing view of the device 100. In accordance with the present disclosure, the housing 102 may comprise a dome-shaped shell 104 and a device baseplate 106. A pad 108 may be disposed on a bottom surface of the baseplate 106 to support the housing 102 on a table 10. In accordance with the present disclosure, the microphone ports 112 may be positioned in the housing 102 so as to be low to the table 10. FIG. 7 shows the microphone ports 112 to be top-ported. In accordance with some embodiments, the height H (FIG. 7A) of the housing 102 may be less than or equal to the distance D from the center of the housing 102 to its periphery.

Figure 8:
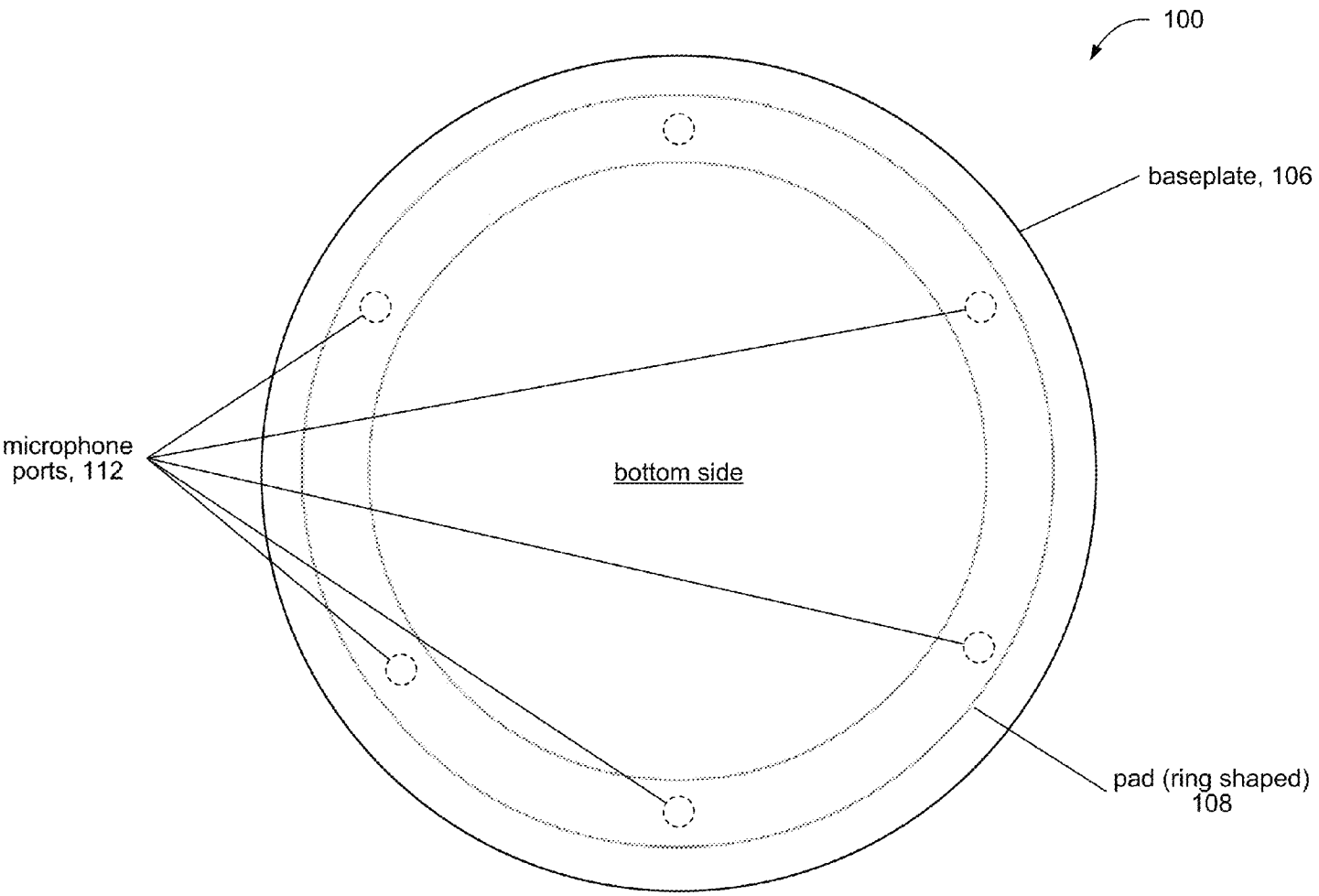
FIG. 8 shows a bottom view of the device with microphones ported upward.

FIG. 8 shows the bottom side of device 100. In some embodiments, the pad 108 may be an annular (ring-shaped)

member disposed peripherally about the perimeter of the baseplate 106. The pad 108 can prevent sound from resonating underneath the device 100. In other words, the pad 108 can prevent the formation of a resonant cavity underneath the device 100. The pad 108 can isolate the device 100 from a hard surface to avoid vibrations from the surface coupling to the microphones (not shown). The pad 108 may be a soft material to dampen sound and surface vibrations of a table 10. For example, in some embodiments, the pad 108 may be a soft rubber material or other suitably compliant material. Being compliant, the pad 108 can provide a substantial seal between the device 100 and the table 10 even if the table 10 has an irregular surface.

Figure 9:
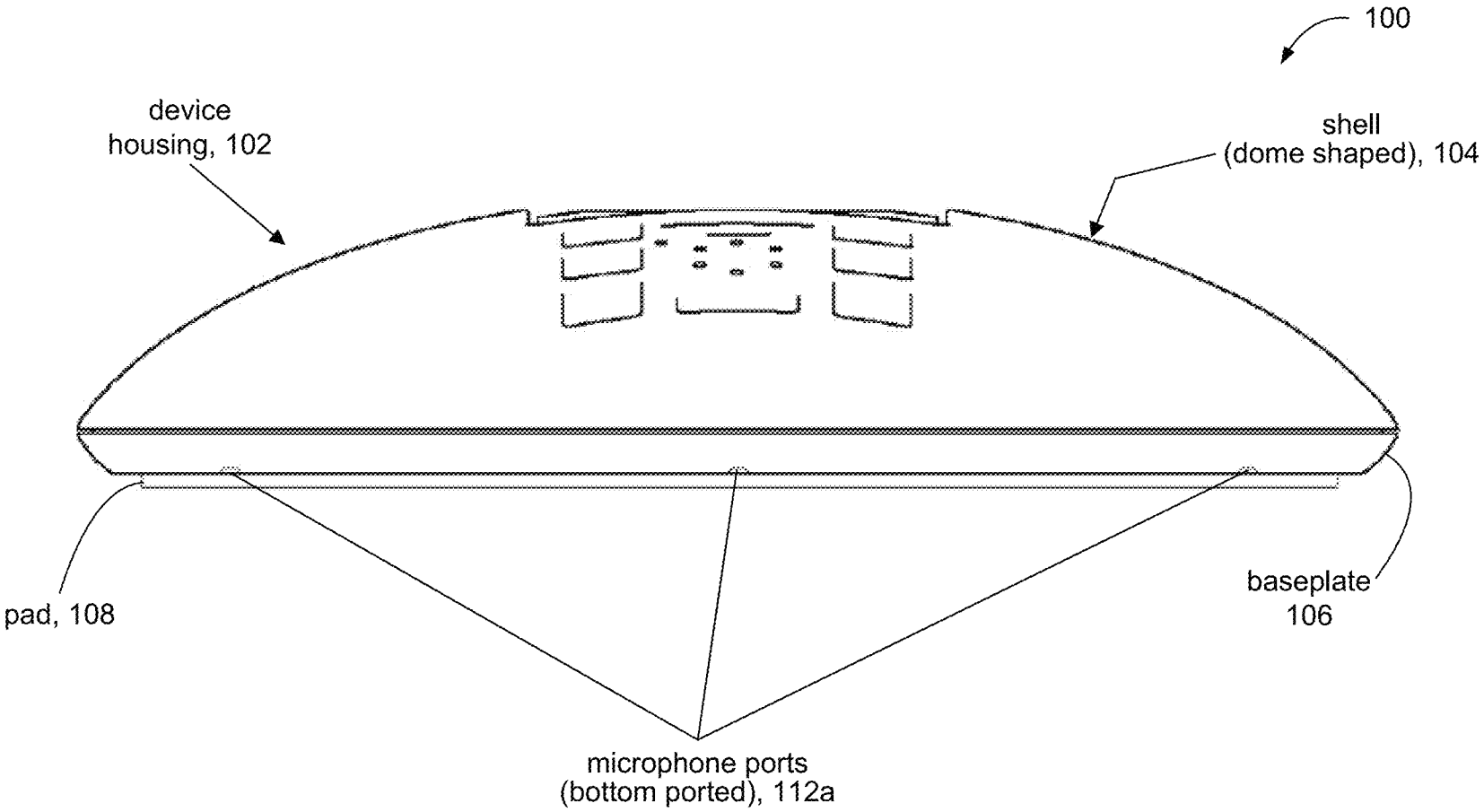
FIG. 9 shows a plan view of the device with microphones ported downward.
Figure 10:
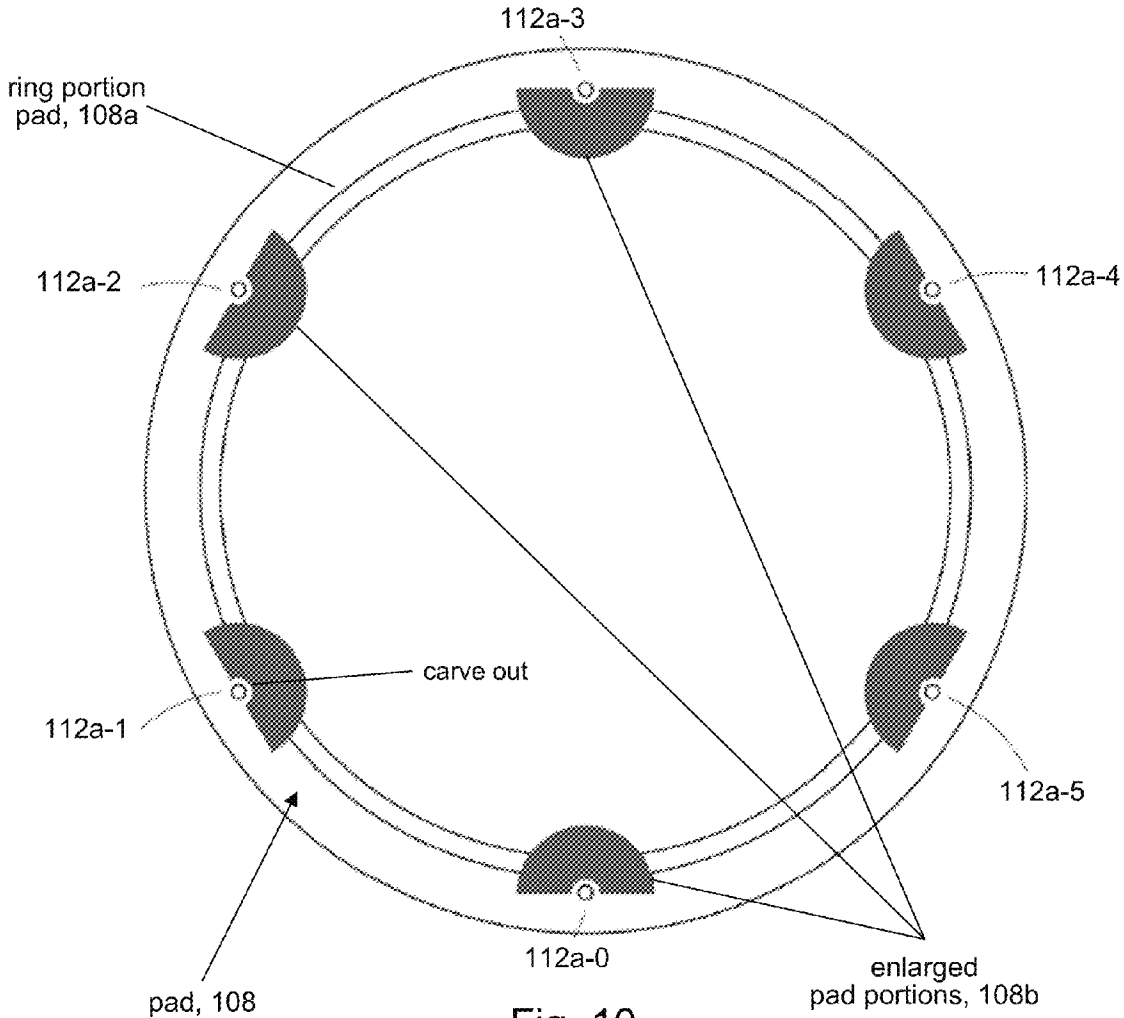
FIG. 10 shows a bottom view of the device with microphones ported downward.

FIG. 9 is a table-level front-facing view of device 100 having bottom-ported microphone ports 112*a*. FIG. 10 shows the bottom side of the bottom-ported device 100 shown in FIG. 9. In some embodiments, the pad 108 may comprise annular segments 108*a* and enlarged pad portions 108*b* connected together by the annular segments 108*a*. Each microphone port 112*a* may be partially enclosed by a corresponding one of the enlarged pads 108*b*. In some embodiments, for example, each enlarged pad portion 108*b* may include a carve-out to partially enclose its corresponding microphone port 112*a*. The enlarged pad portions 108*b* ensure that sound does not resonate near the microphones. These enlarged pad portions 108*b* can block the local effect of any resonance. A reduced footprint for each enlarged pad portion 108*b* can create more compression on each enlarged pad portion 108*b*.

Figure 11:
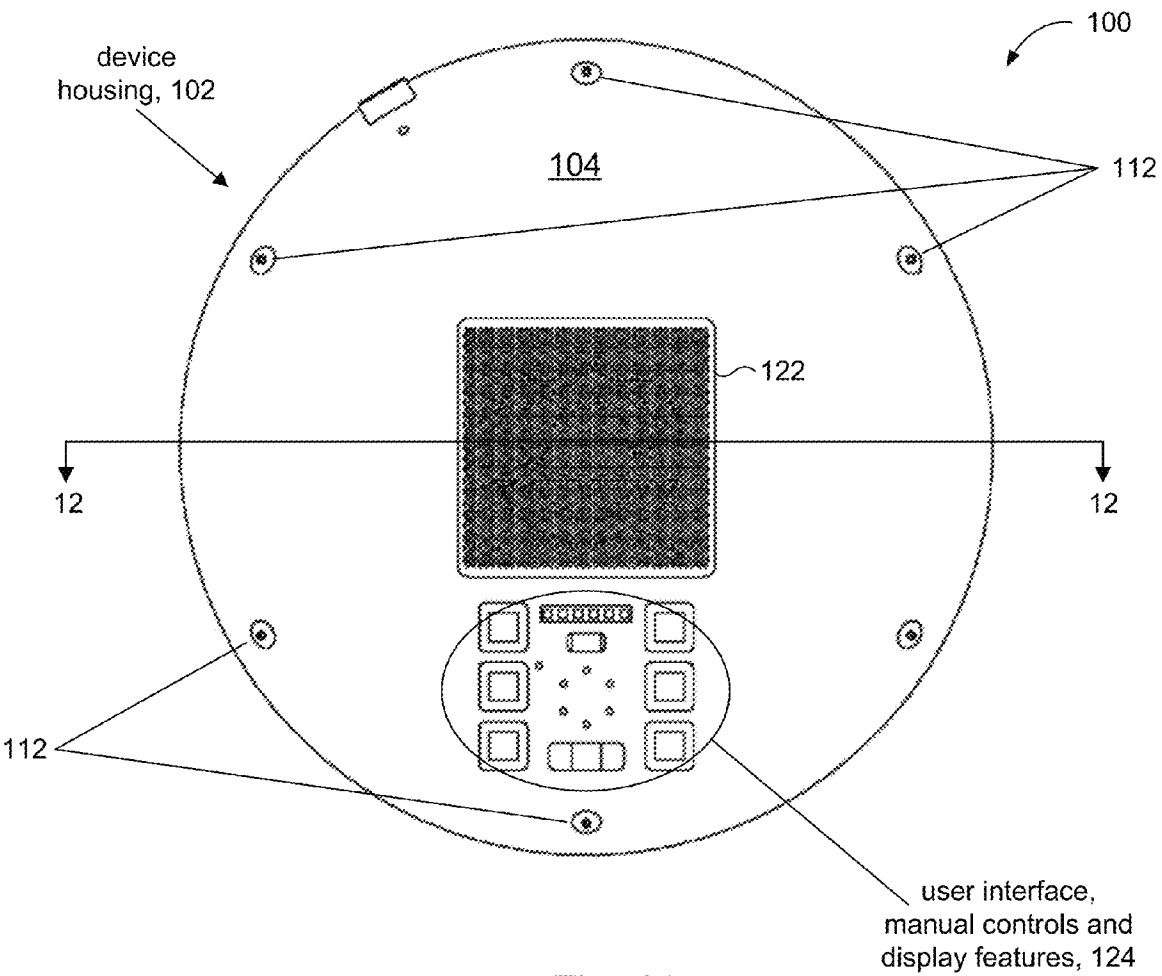
FIG. 11 shows a top view of the device with microphones ported upward.

FIG. 11 shows a top view of the device 100 configured with top ported microphones. In some embodiments according to the present disclosure, the footprint (perimeter) of the device 100 may have a circular shape. In other embodiments, the footprint may be any symmetrical shape other than circular; e.g., hexagonal, heptagonal, octagonal, and so on. The top view shown in FIG. 11 shows that in some embodiments, a loudspeaker 122 may be provided at the top center portion of the shell 104 of housing 102. As noted above, the top-ported microphone ports 112 may be formed in shell 104 and arranged symmetrically about the perimeter of the housing 102, and in particular the loudspeaker 122. This arrangement of the microphone ports 112 allows for the microphones (not shown) to be positioned equidistant from the loudspeaker 122. Manual controls and display features (user interface subsection) 124 may be located so that they are generally tangential to the surrounding surfaces of the shell 104. The manual controls and display features 124 may be organized and positioned on the device 100 to allow the loudspeaker 122 to stay in the center of the symmetric perimeter of the device 100.

The relative arrangement between the loudspeaker 122 and microphone ports 112 can be advantageous because direct sound from the loudspeaker 122 can couple into (picked up by) each of the microphones (not shown) equally. This arrangement makes it easier to detect the direction of sound from a talker even when the loudspeaker is playing sound.

The device 100 should be able to detect and located sound from any direction simultaneously as sound is being played out the loudspeaker 122. Direction finding, however, can be hampered by echoes. Modern speakerphones use echo cancellation to remove most of the echo, but some echo usually remains; this is called residual echo. Residual echo can corrupt or otherwise make difficult the process of direction-finding in a configuration where the loudspeaker is closer to some microphones than to other microphones. For example, residual echo can give a false indication that the talker's voice is coming from the direction of the nearest microphone. Since the loudspeaker in accordance with the present disclosure is centered and the microphones are equal distance from the loudspeaker then the residual echo is usually about equal in each microphone, and so the misleading effect of residual echo can be reduced.

Figure 12:
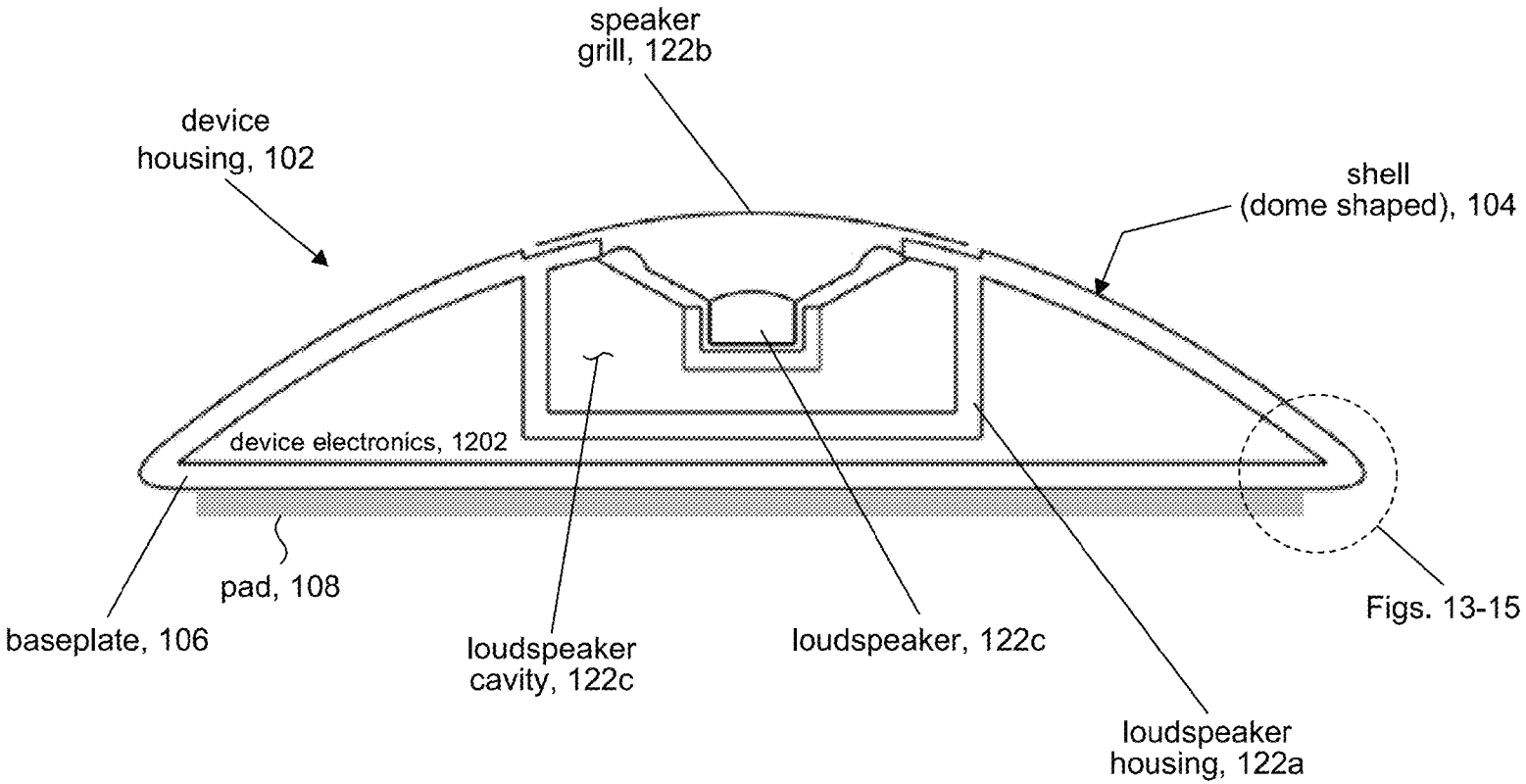
FIG. 12 shows a simplified cross section of the device.

FIG. 12 shows a simplified cross section of the device 100 taken along view line 12-12 in FIG. 11. The device housing 102 may house, among other components, various device electronic 1202, which may include electronic components to support operation of the microphones 112 (e.g., amplifiers, A/D converters, filters, etc.) and electronic components to support data processing components to process signals received by the microphones 112 (e.g., CPU, DSP, ASIC, programmable logic such as FPGA, etc.). The loudspeaker 122 may be housed in a loudspeaker housing 122*a* and speaker grill 122*b* (which together define a loudspeaker cavity 122*c*) formed in the device housing 102. The curvature of the housing 102 adds stiffness to the device 100. The fact that the microphones (e.g., 112, FIG. 10) are near the edge of the device 100 minimizes vibrations due to the loudspeaker 122. Even if the housing 102 vibrates from the force of the loudspeaker movement, the vibration coupling is minimal because the microphones are located at a joint where the shell 104 and the baseplate 106 are joined or otherwise connected.

Figure 12A:
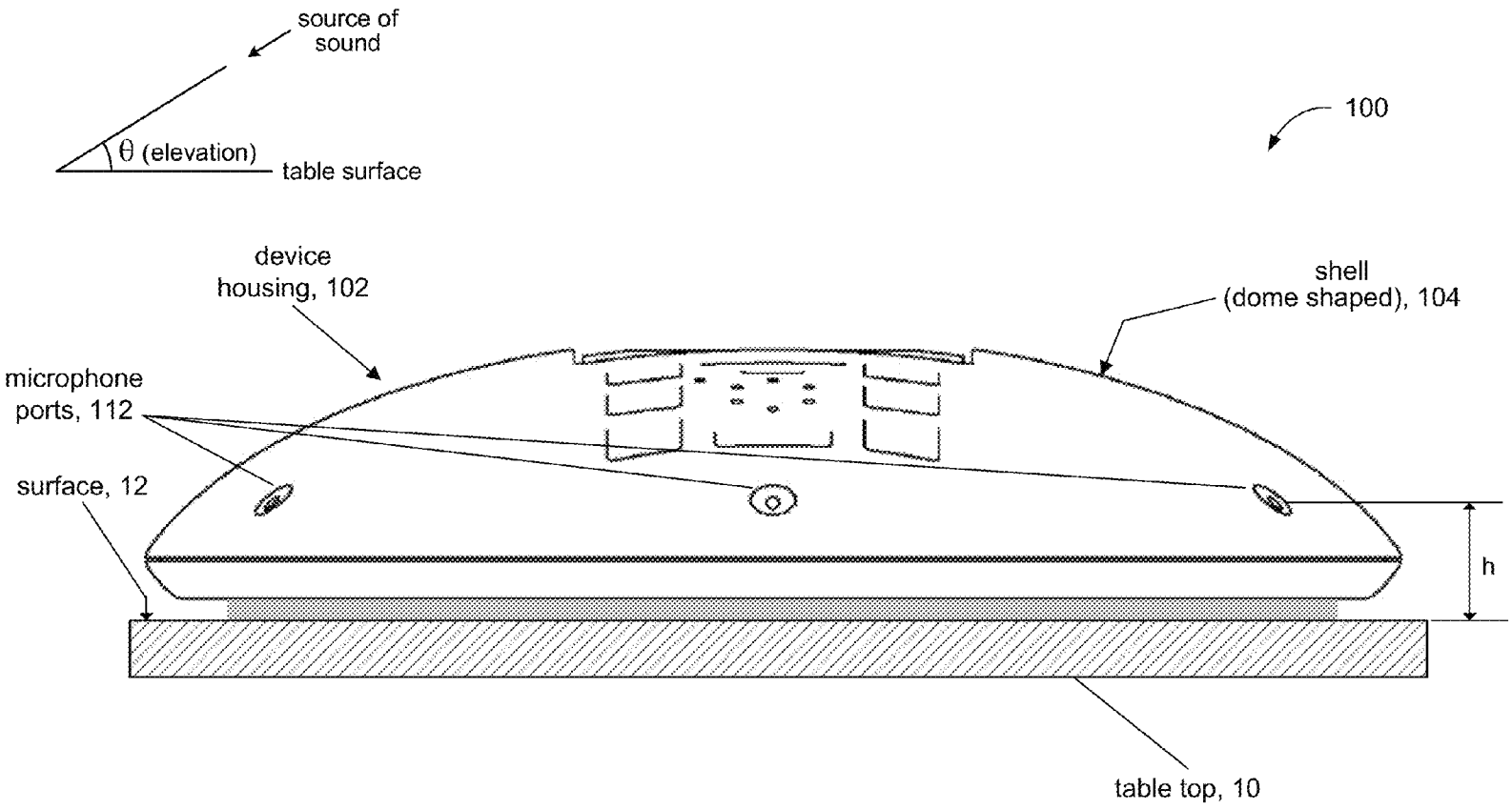
FIG. 12A shows a plan view of the device, illustrating microphone height.

The front view, of FIG. 12A, shows the profile of the shell 104 for the embodiment where the microphones 112 are top ported. Ignoring the details of the plastic surface for the moment, for sound arriving from directly overhead the sound can cancel itself when the height h equals one fourth of the wavelength. The sound bounces off of the table 10 and the total distance the sound travels before interfering at the microphone hole is half the wavelength. At that frequency, the sound can be cancelled totally, creating a null in the spectrum. This can result in poor sound and since the direct path was cancelled, then the null will be filled in with reverberant sound. The sound quality is bad, which can cause speech recognition errors. Sound coming from straight above is the worst case ($\theta=90°$). At other angles ($\theta<90°$) the wavelength will be smaller before cancellation begins. The difference in time of arrival of the direct sound and the table bounce are based on the formula: $T_d=(2\times h/c)\times\sin(\theta)$ where $\theta$ is the angle measured between the table 10 and the source of the sound, h is the height of the microphone port, and $T_d$ is the resulting delay between the direct sound and the reflected path. When $\theta$ is 90° (e.g., directly above the microphone), then $T_d=2\times h/c$. Note that this formula makes the approximation that the source of the sound comes from far away relative to the height h. If the source of the sound is closer, the formula will be more complicated without adding much value to this discussion. As will be shown in the tables below, the gain at higher frequencies decreases with increasing height h. Accordingly, in some embodiments, a smaller h may be desirable in order to retain the higher frequencies.

In the case of the embodiment with the microphones ported to the top (e.g., FIG. 13), suppose as an example, the height h1 of the microphone port from the table surface is 10 millimeters. For sound arriving from directly overhead the attenuation is based on the difference time of arrival being $T_d=2\times h1/c$, where c is the speed of sound and h1 is the height of the microphone port above the table surface. For the case where the port height is 10 millimeters, then the difference in time of arrival is $T_d=2\times 10$ mm/343.95 mm/millisecond, which equals 0.0465 milliseconds. The response of the microphone is determined by the equation:

$$\text{Gain}=20\times\log 10(|(1+e^{-j\times 2\times\pi\times f\times Td})|),$$

where $T_d$ is the difference in time of arrival between the direct sound and the reflection off of the table. For sound, directly overhead, at 90°, $T_d=0.0456$ milliseconds. For sound arriving from 45° above the table $T_d$=0.0456*sin (45°)=0.0322 milliseconds. As the angle of arrival becomes more horizontal and less vertical, the time difference between the direction sound and the reflection becomes less and less. Therefore the attenuation of sound due to the reflection is less of a problem for a low angle.

At various frequencies f, the gain for a sound source coming from straight overhead) (90°) as compared to an angle relative to the table (e.g., 45°) is shown in the table below. The configuration assumes the microphone port is located at a height 10 millimeters above the surface of a table (e.g., table top 10, FIG. 7).

| f = Frequency (kHz) | Gain (dB) at 90° | Gain (dB) at 45° |
|---|---|---|
| 1 | 5.87 | 5.94 |
| 2 | 5.42 | 5.73 |
| 4 | 3.46 | 4.81 |
| 7 | −4.79 | 1.85 |

As can be seen from the table above, at this height the frequency response is effective up to 4 kHz for all angles. It will be rare that a talker will be speaking from directly overhead of the device, so if they are speaking so that the talker's mouth is at 45°, there is only about 1 dB of attenuation at 4 kHz. This system would function well for a frequency range commonly called "narrowband" or "telephone" speech. As of this writing, this is the most common range for telephony and mobile speech.

Figure 13:
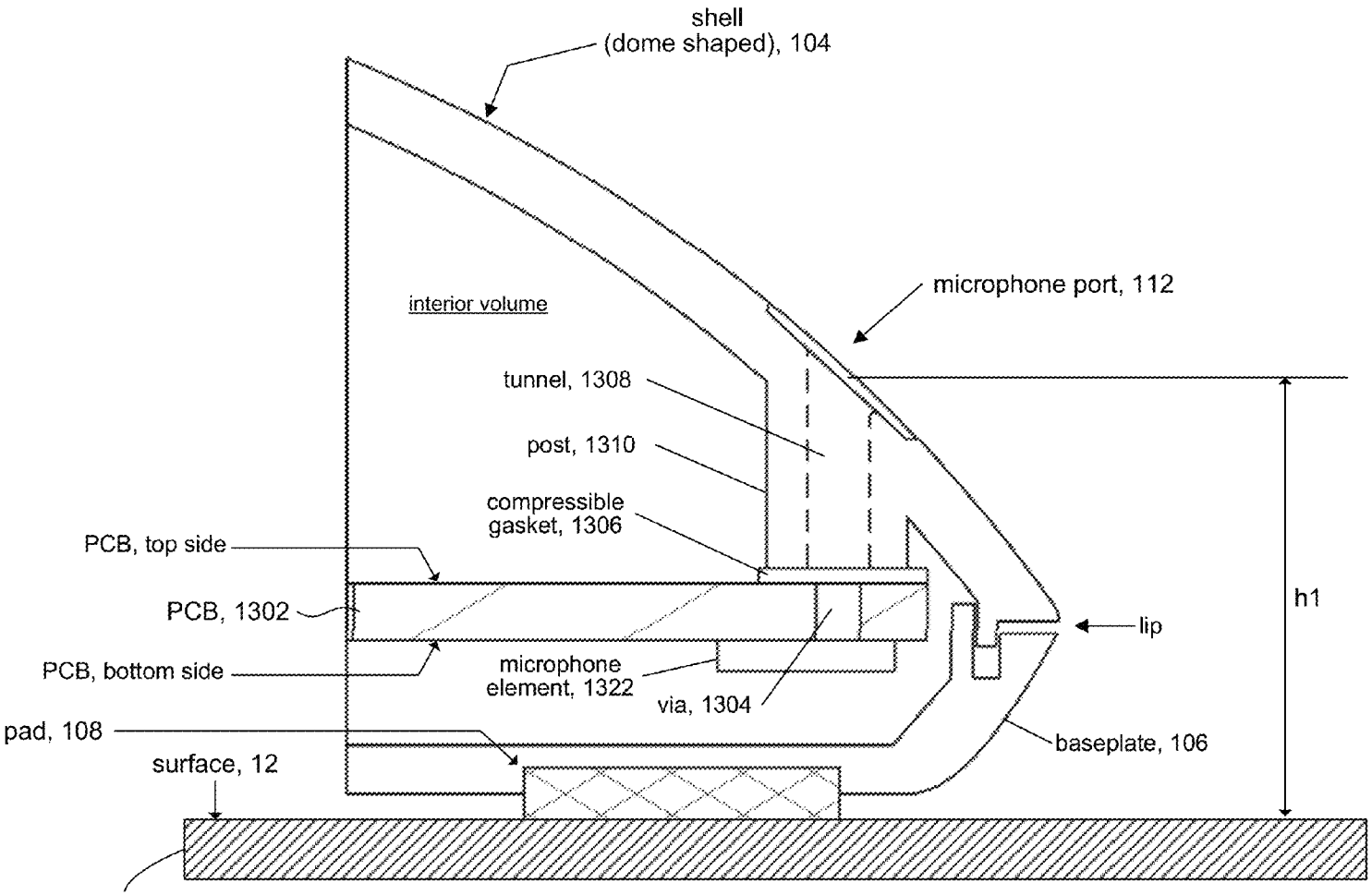
FIG. 13 shows the interior cross section of the device for an embodiment where the microphones are ported to the top.

FIG. 13 shows the interior cross section of the device for the embodiment where the microphones are ported to the top. In some embodiments, each microphone may be the same. The microphones may be constructed by surface-mounting the microphone elements 1322 onto a circular printed circuit board (PCB) 1302 for carrying or otherwise supporting the device electronics (not shown). In some embodiments, the microphone elements 1322 may comprise MEMS (Micro Electro-Mechanical Systems) bottom-mounted style microphone elements. They may be attached to the PCB 1302 by solder, glue, and the like. A via 1304 formed through the PCB 1302 and aligned with the microphone element 1322 may provide an air path from the bottom side of the PCB 1302 to the top side of the PCB 1302. A compressible gasket 1306 may be aligned with the via 1304 to provide a seal with an air passage tunnel 1308 formed through a post 1310 of the shell 104. The opening through the tunnel 1308 may be cylindrical or may progressively get wider and open upward toward the microphone port 112. One end of each post 1310 is aligned with a microphone element 1322, and another end of each post 1310 terminates at a microphone port 112. There may be one such post 1310 for each microphone element 112.

Figure 14:
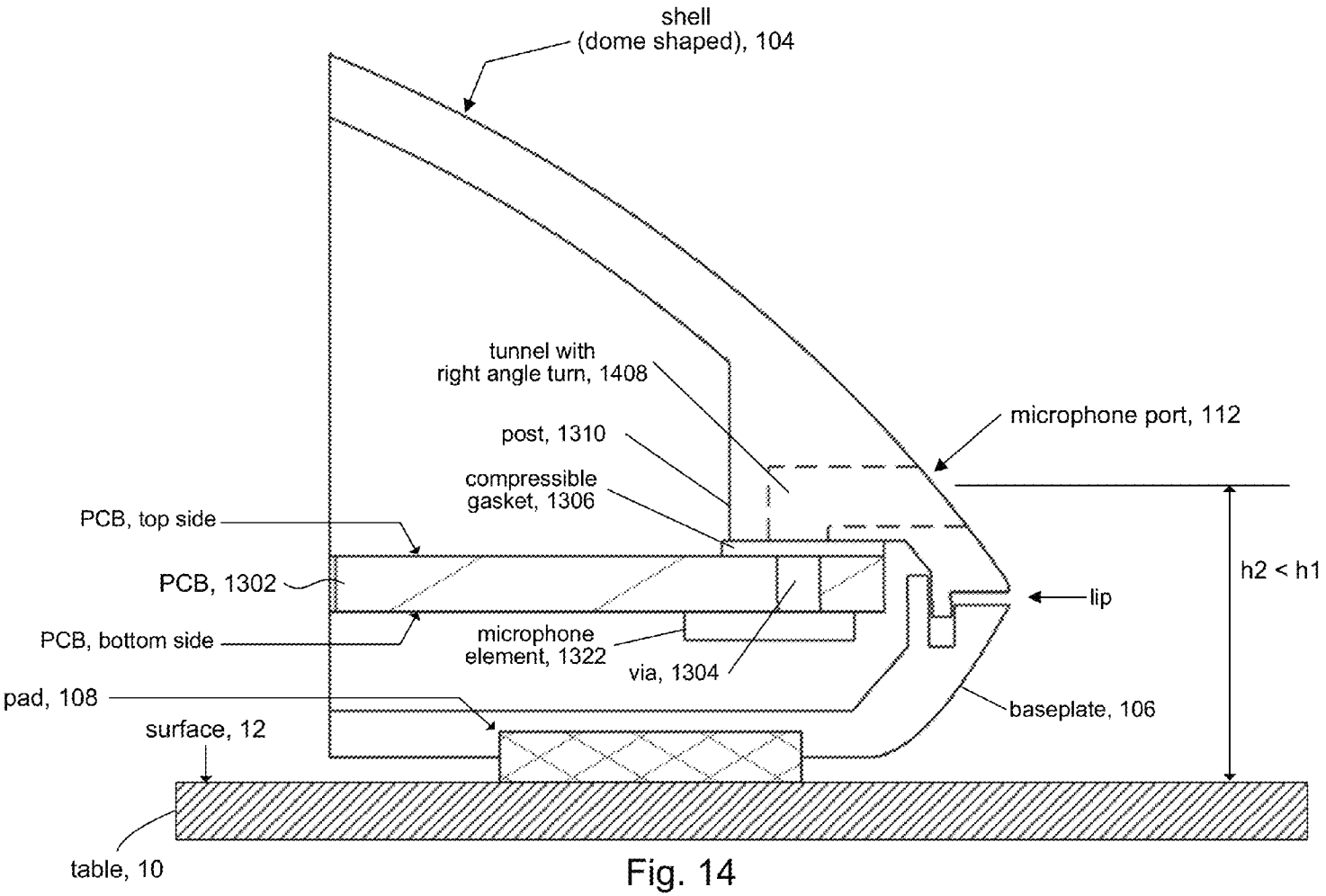
FIG. 14 shows the interior cross section of the device for the embodiment where the microphones are ported sideways.
Figure 15:
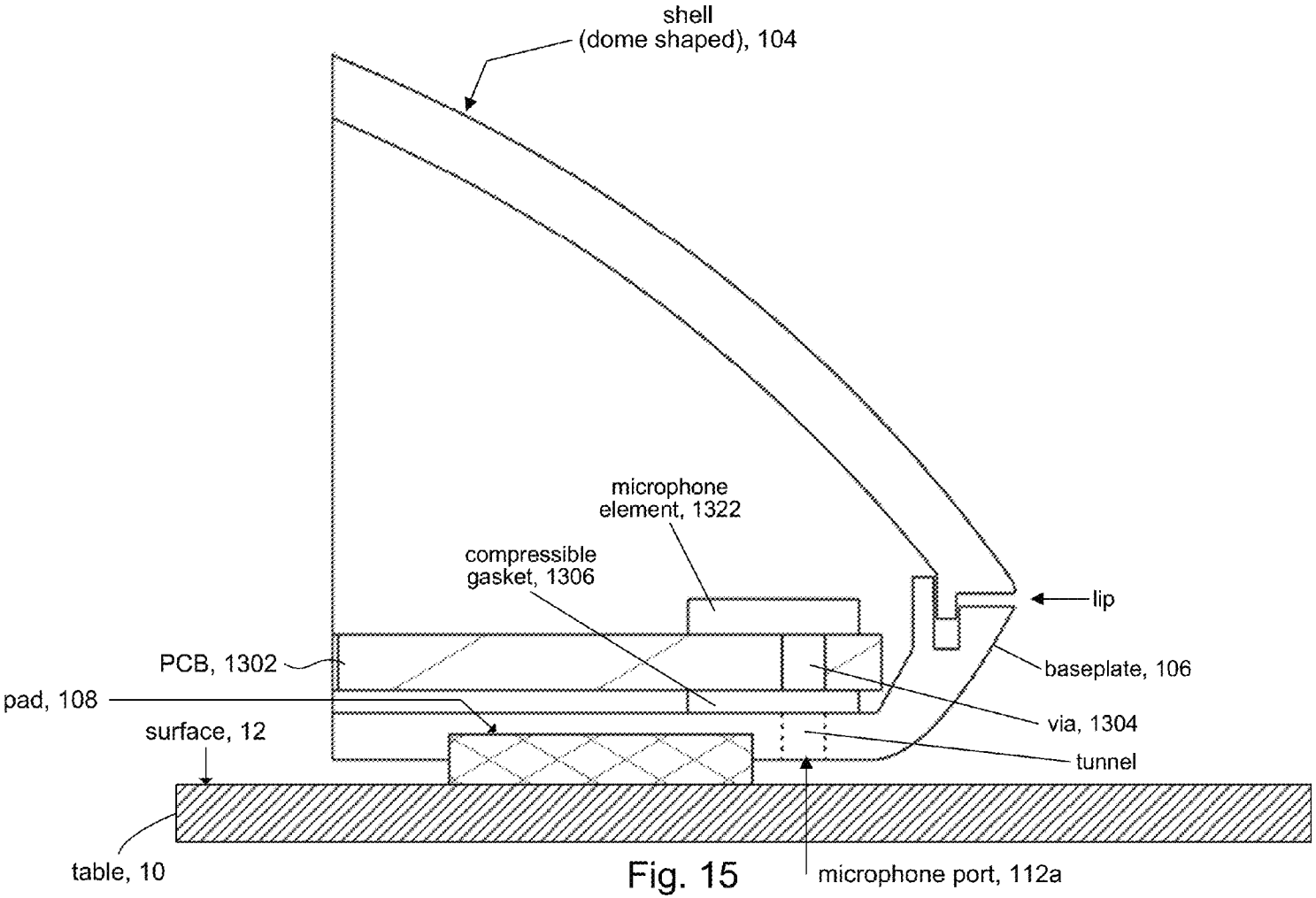
FIG. 15 shows the interior cross section of the device for the embodiment where the microphones are ported to the bottom.

Referring to FIG. 14, in other embodiments, the tunnel 1408 may turn at a right angle to port to the side. In yet another embodiment, FIG. 15 shows a cross-section where the microphone port 112 is directed underneath the lip of the device, i.e., the bottom ported embodiment. In some embodiments, the lip may be omitted; in other words, the slope of the device 100 may continue toward the table surface.

Now consider a microphone porting where the microphone port 112 is at a lower height in a similar situation, such as shown in FIG. 14 for example. Consider a height h2 (<h1) of 7.5 mm. See the response in the table below:

| f = Frequency (kHz) | Gain (dB) at 90° | Gain (dB) at 45° |
|---|---|---|
| 1 | 5.94 | 5.98 |
| 2 | 5.69 | 5.86 |
| 4 | 4.64 | 5.35 |
| 7 | 1.15 | 3.85 |

At this height, the response is reasonably acceptable at 45° for a frequency up to 7 kHz.

Figure 15A:
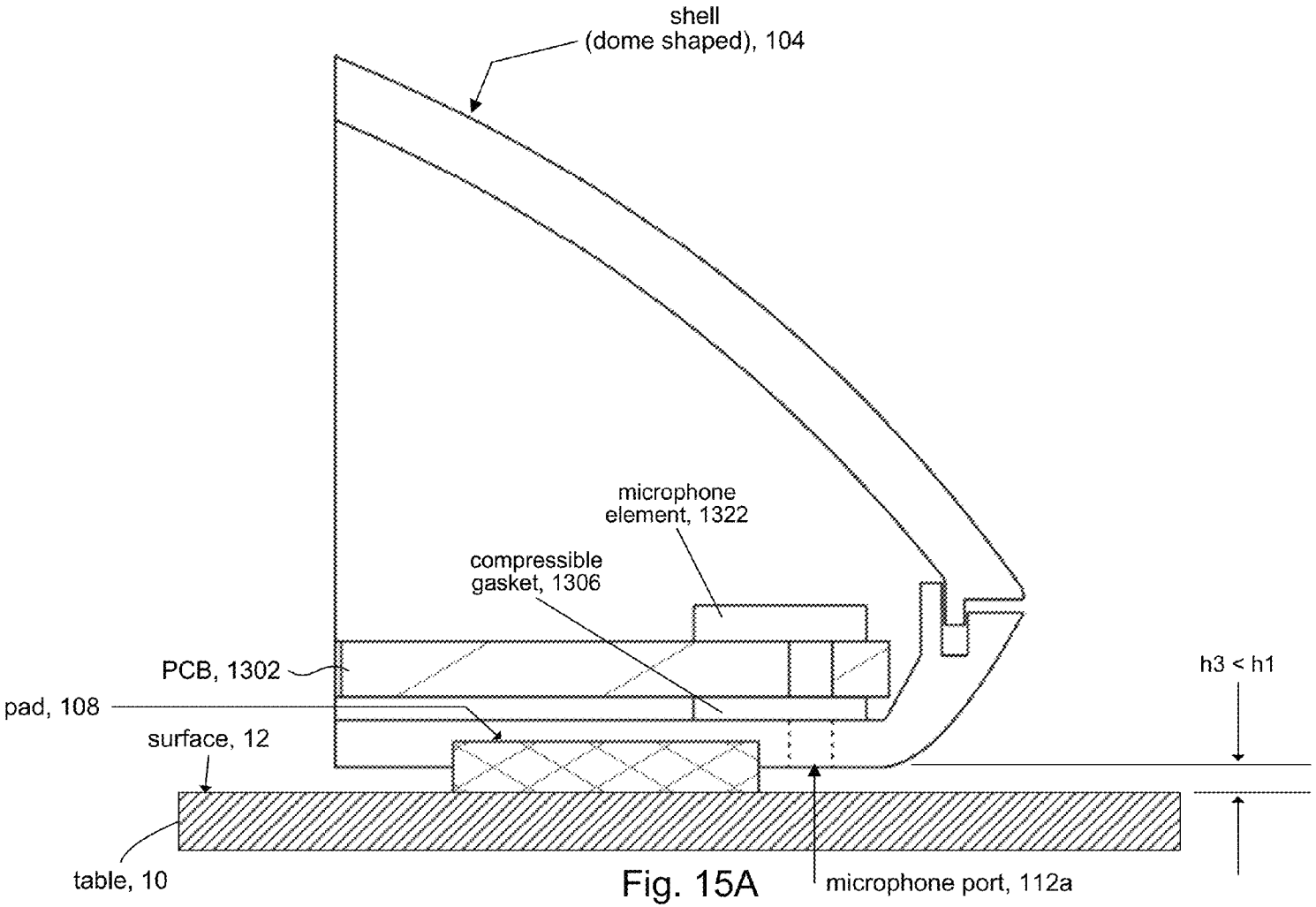
FIG. 15A illustrates the microphone height of FIG. 15.

Now consider a microphone porting where the microphone port 112 is at a lower height in a similar situation as shown in FIG. 15A, for example, where the microphone port 112 is directed underneath the lip of the device. Consider a height h3 (<h1) of 5.0 millimeters. See the response in the table below:

| f = Frequency (kHz) | Gain (dB) at 90° | Gain (dB) at 45° |
|---|---|---|
| 1 | 5.98 | 6.00 |
| 2 | 5.87 | 5.95 |
| 4 | 5.43 | 5.73 |
| 7 | 4.1 | 5.10 |

As the height of 5.0 millimeters, the frequency response is acceptable up to 7 kHz. At 7 kHz, the frequency response is useful for a range of frequencies commonly called "wideband". As of this writing, the band is common for video conferencing on services such as Skype™ messaging and is the common frequency range for performing speech recognition.

The fact that the sound pressure arrives at the microphone 122 both from direct sound and the reflection actually doubles the sound pressure. Consequently, except for interference, the sound pressure doubles. As shown above a doubling in pressure results in an increase of sound pressure of 6.02 dB. It should be noted that these numbers are approximate and the actual response is complicated by the shape of the plastic enclosure near the microphone ports and the table.

Figure 16A:
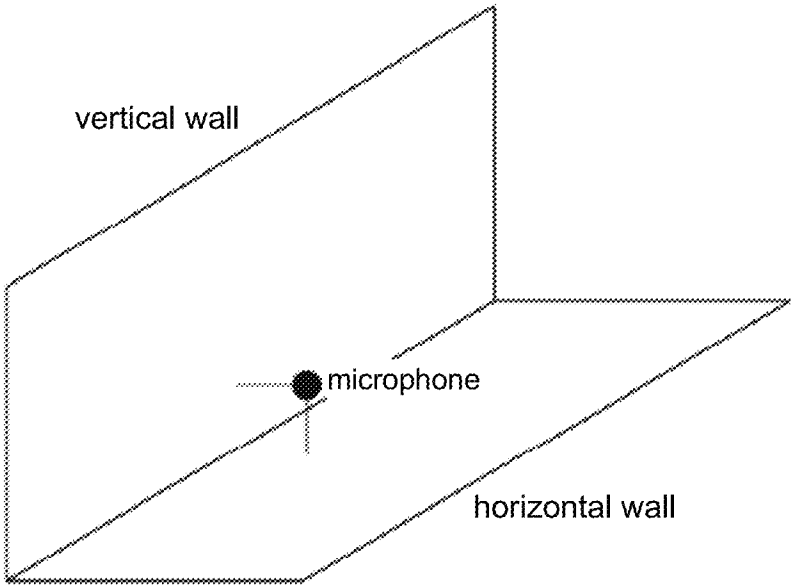
FIGS. 16A and 16B show a hypothetical corner with microphone.
Figure 16B:
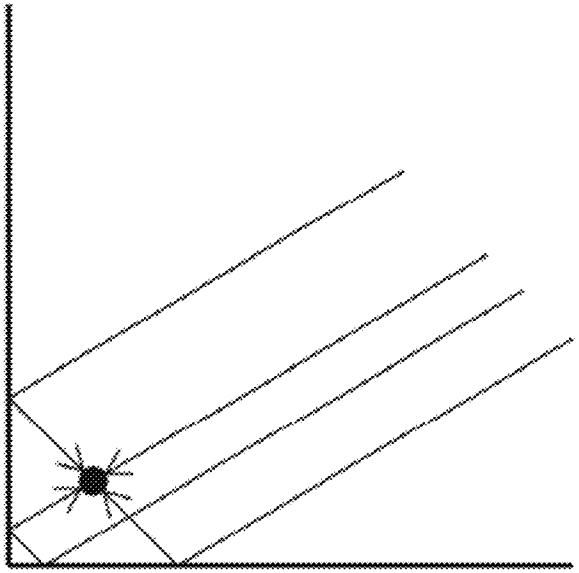

In general, the sound pressure at any point on a table 10 is double what it would be if there was not a table as long as the microphone port 112 is very close to the table 10. Consider a hypothetical case where a microphone 122 is mounted very close to a corner as shown in FIGS. 16A and 16B, where there is a horizontal wall intersecting with a vertical wall. If a plane wave were to strike an actual corner with the microphone sensor positioned at a distance very small compared to the wavelength then it will actually sense four sources (direct line and three reflections) altogether and the pressure sensed at the microphone will be 4 times greater or 12 dB, as illustrated in FIG. 16B.

Figure 17:
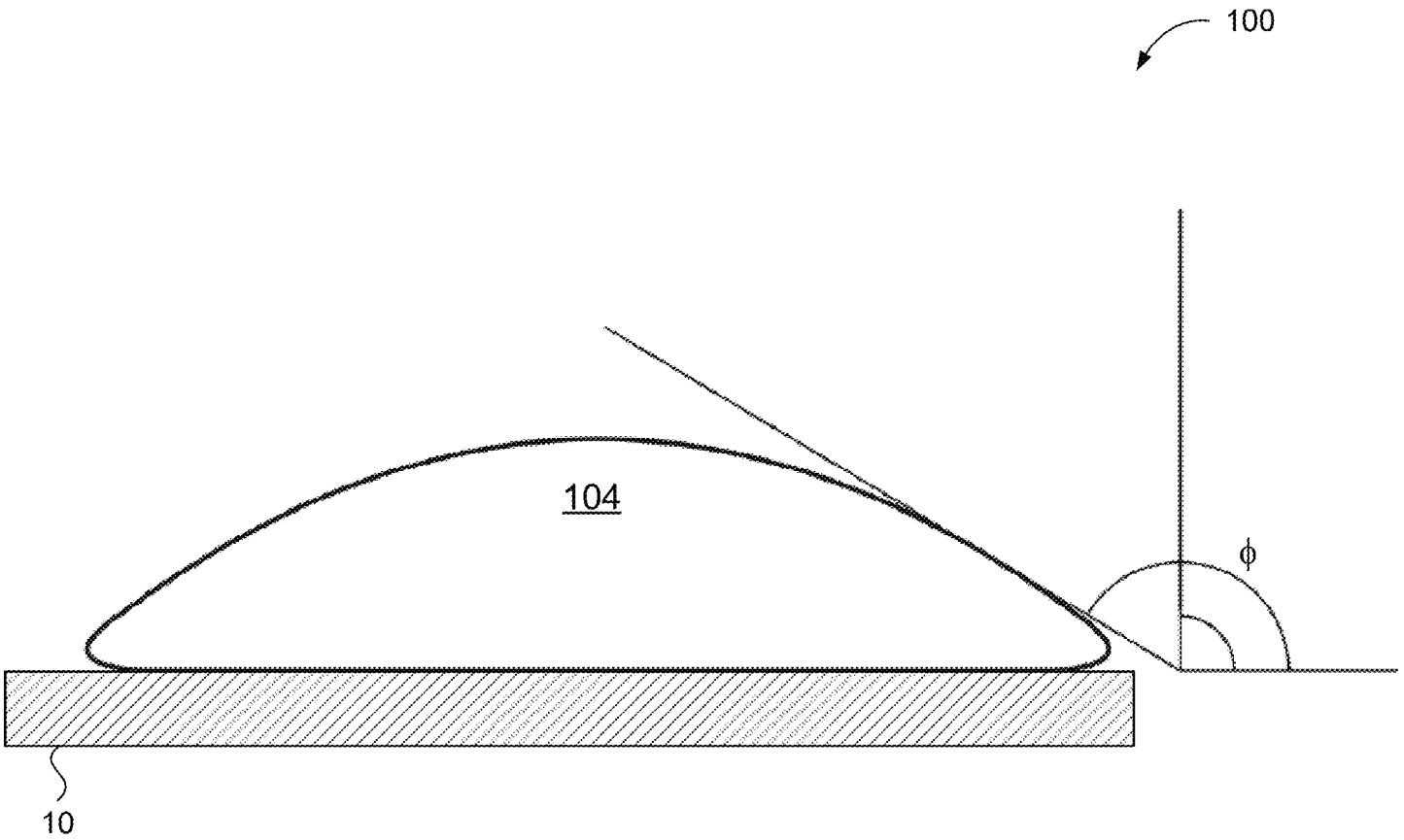
FIG. 17 shows a side view with microphone port underneath the device.

Now consider the side view. FIG. 17 shows that the area where the surface of shell 104 intersects with a table 10 forms a small corner, although the angle $\phi$ at the intersection is bigger than a 90° angle. When sounds with wavelength small compared to the dimensions of the device 100 impinge at the corner formed by the intersection of the table 10 and the shell 104 of device 100, then the increase in sound pressure can increase as much as 12 dB. At the same time, for sounds coming from the other side of the device 100 there will be a shadow where the sound pressure is much less than sounds coming toward the device 100. This shadowing will only occur at higher frequencies where the wavelength is comparable to the dimensions of the device 100. For low frequencies there will be no shadowing as the low frequency sound will simply wrap around the device 100.

Figure 18:
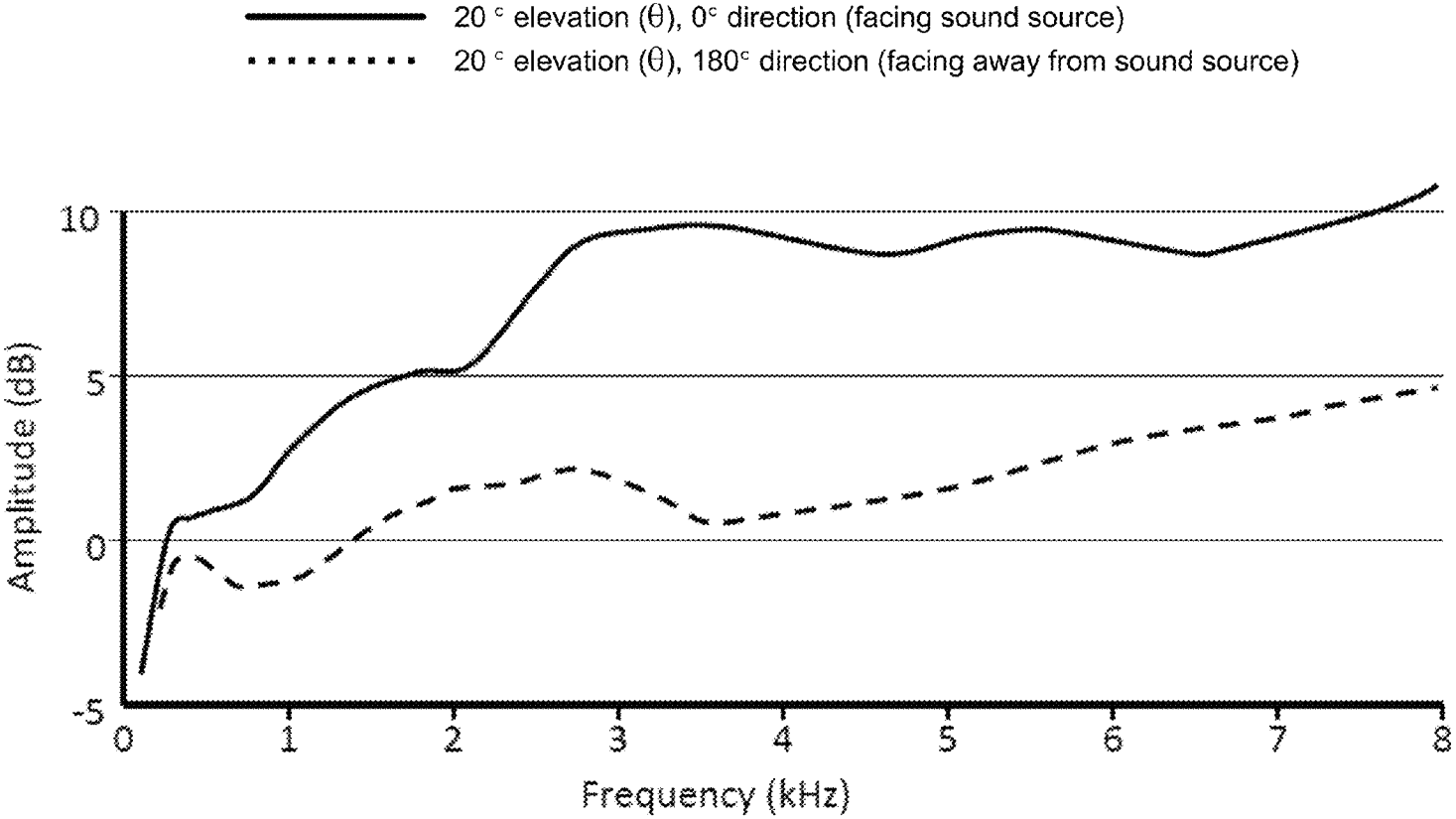
FIG. 18 shows typical frequency responses for sound coming to the front and rear.

A frequency response for sound coming from a typical talking position (e.g., 50 centimeters away and 30 centimeters above the table) is shown in FIG. 18. The frequency response of a microphone for sound received in the direction of the source is illustrated by the solid line graph. The frequency response of the microphone for sound coming from the opposite direction is shown by the dashed line graph. The difference in the signal levels shows that there is considerable directivity for sound hitting the front of the device versus sound coming from the rear. The difference in signal is most pronounced above 2.5 kHz. The ripples in the frequency response plot are due to the elevation of the microphone port of 1 centimeter above the table. This measurement was made with a device that is 15 centimeters in diameter and 3.3 centimeters in height. It is a reasonable conclusion that if the height is lowered by 33%, then the frequency where there is pronounced directivity would move from 2.5 kHz to 3.75 kHz. It is reasonable to conclude that a height of less than 20 millimeters would provide no significant improvement in directivity.

Figure 19:
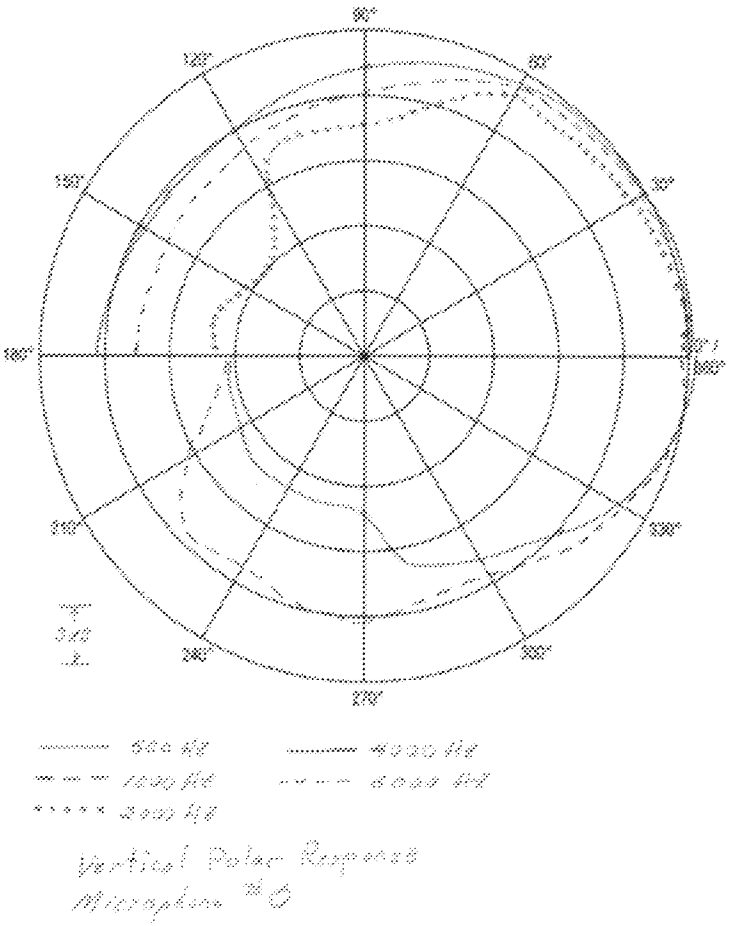
FIG. 19 shows the vertical polar response at various frequencies.
Figure 20:
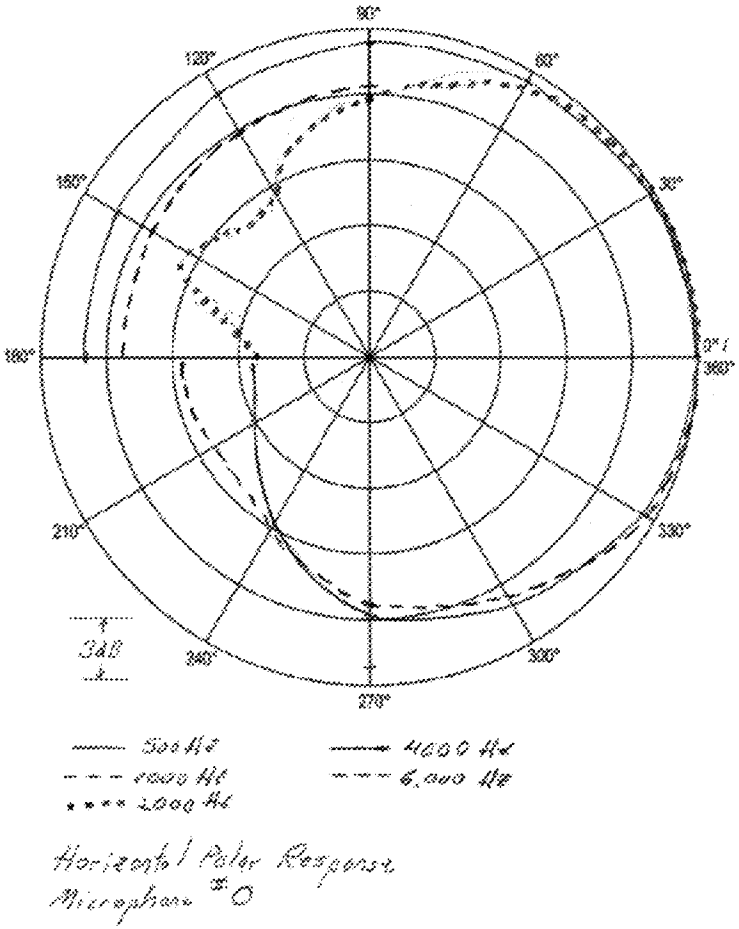
FIG. 20 shows the horizontal polar response at various frequencies.

The next three figures show polar responses at different frequencies of a single microphone for a dome structure that is 15 centimeters inches in diameter at the base, 3.4 centimeters in height and a circular segment cross section. FIG. 19 shows the vertical response and FIG. 20 shows the horizontal response. At frequencies above 2 kHz, the directionality of the polar plot is quite comparable to a cardioid shape.

It is common in acoustic literature to talk about a ratio called the Directivity Index (DI). The Directivity Index is the ratio of the total noise power in an isotropic noise filled environment, incident on an array, compared to the power actually received by the system, the omni directional noise. $DI=10\times\log_{10}(N_omni/N_processed)$. When the array is useful the directivity index is positive. The Directivity Index is a method of summarizing the effectiveness of an array. A weakness of using the Directivity Index is that it is possible to design an array with an amazing Directivity Index, but with an unusable beam that is so narrow that it is too fragile for reliable pickup and there may be many and extreme side lobes pointing in the wrong directions. However, for a simple system, i.e., a single microphone the Directivity Index is a very good measure for the effectiveness of the directionality.

Figure 21:
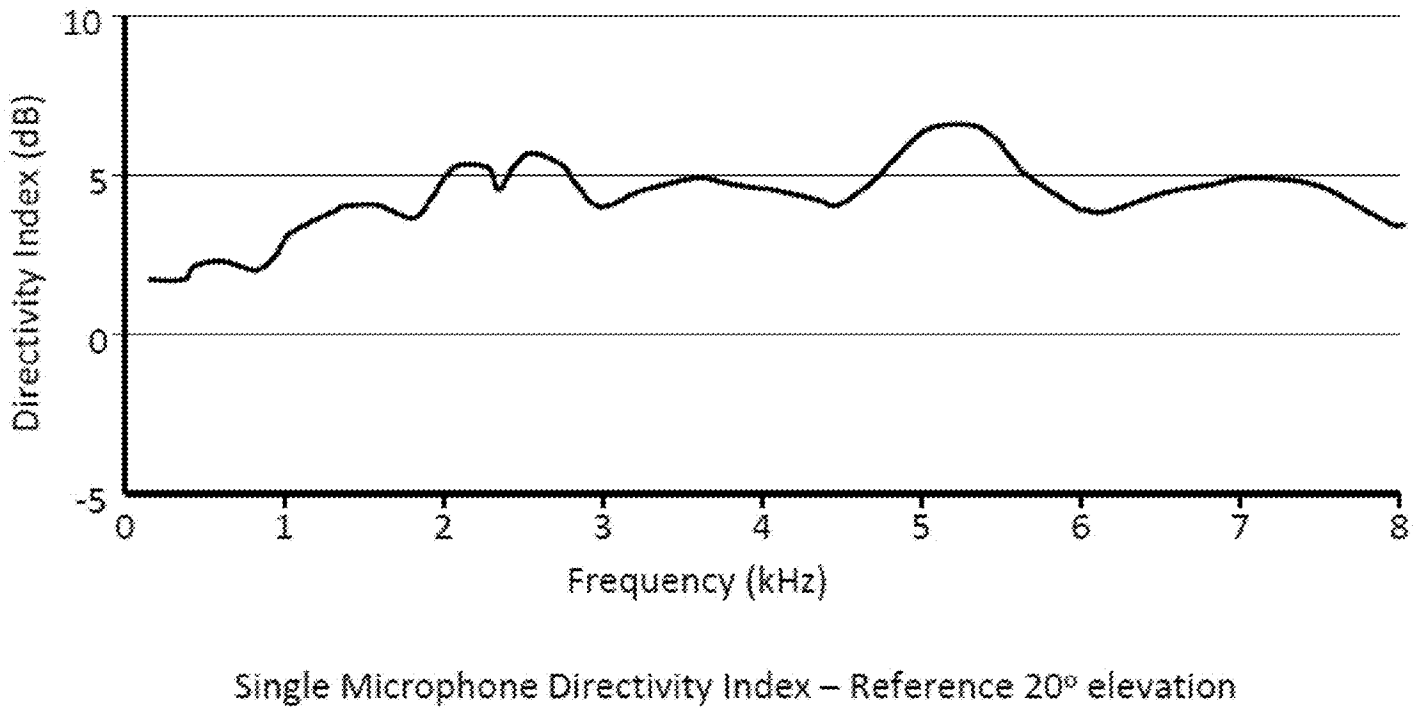
FIG. 21 shows Directivity Index for a single microphone using the device.

Using a device (e.g., 100) configured in accordance with the present disclosure and defining the "look direction" as horizontal toward a single microphone, the device can achieve directivity that varies with frequency as shown in FIG. 21. Note that the directivity improves substantially, especially above 2000 Hz, and above 4000 Hz it achieves very similar directivity as a normal cardioid beam. Since the array achieves so much directivity above 2000 Hz simply due to the dome shape, it is possible to allocate fewer microphones to concentrate on frequencies below 2000 Hz, where most of the speech energy is located.

The change in frequency response due to the shape can be compensated with an equalizing filter to flatten the response. The response will be slightly different depending on the angle of arrival. In general, a single equalizing filter will be sufficient to compensate for typical angle of arrival. However, it is also possible to determine the angle of arrival by using the microphone array to determine the angle of arrival. Using this information, it would be possible to select an appropriate equalizing filter.

Figure 22:
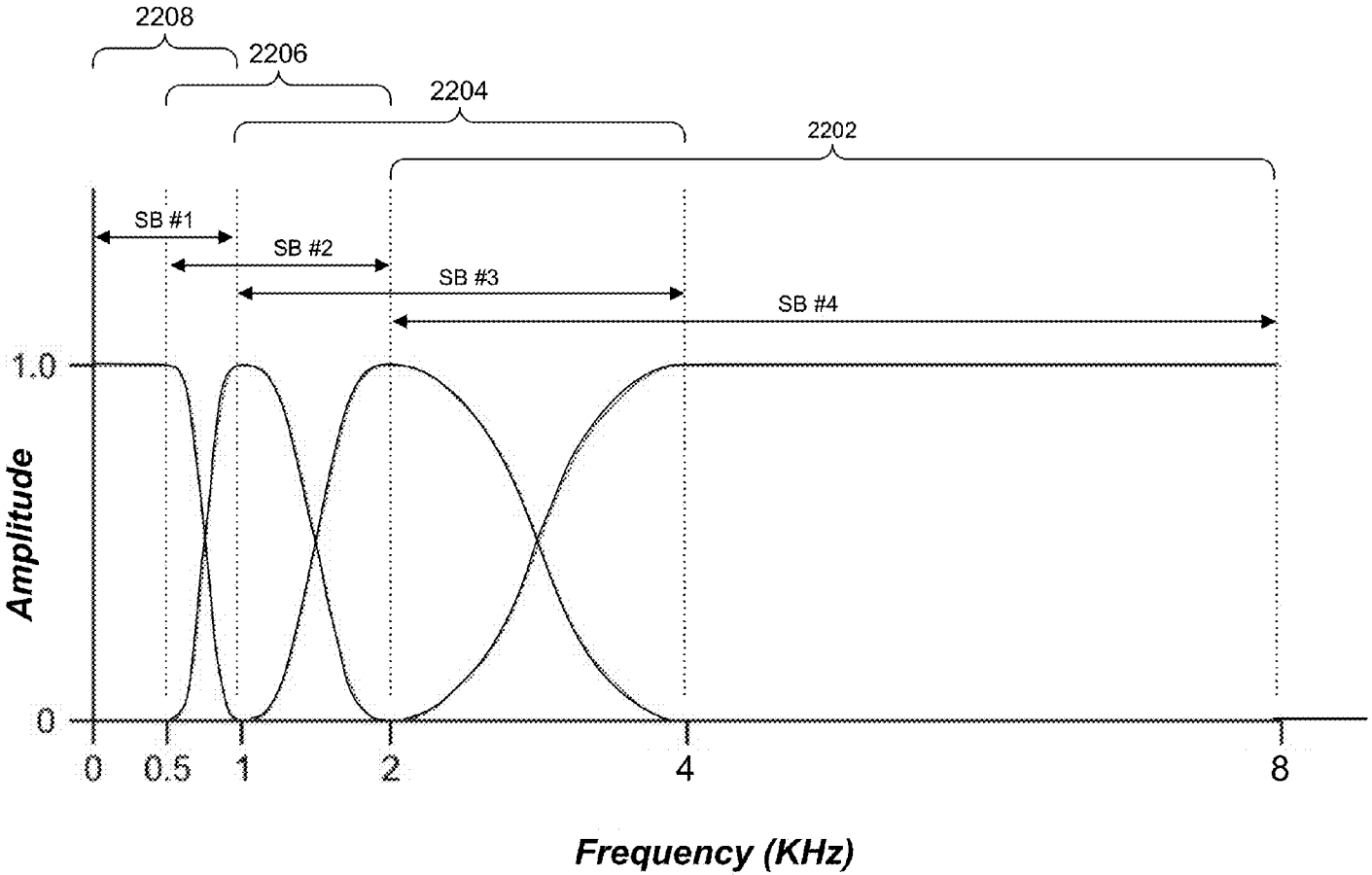
FIG. 22 shows an example of overlapping subbands for one embodiment of the device.

Referring to FIG. 22, in some embodiments, there may be 4 overlapping subbands. In further text these will be referred to merely as a "subband" for brevity rather than "overlapping subband". The high frequency subband (#3) 2202 is from 2000 Hz to 8000 Hz. The next lower subband 2204 (#2) is from 1000 Hz to 4000 Hz. The next lower subband (#1) 2206 is 500 Hz to 2000 Hz, and the lowest subband (#0) 2208 is from 0 Hz to 750 Hz.

Figure 23:
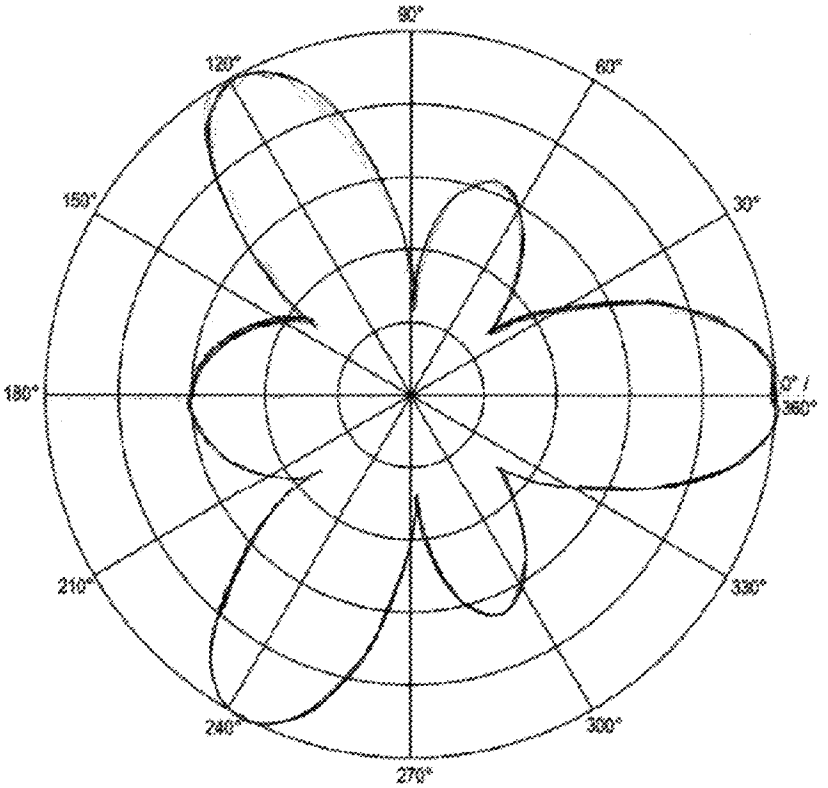
FIG. 23 shows horizontal polar response of six microphones without the housing.
Figure 24:
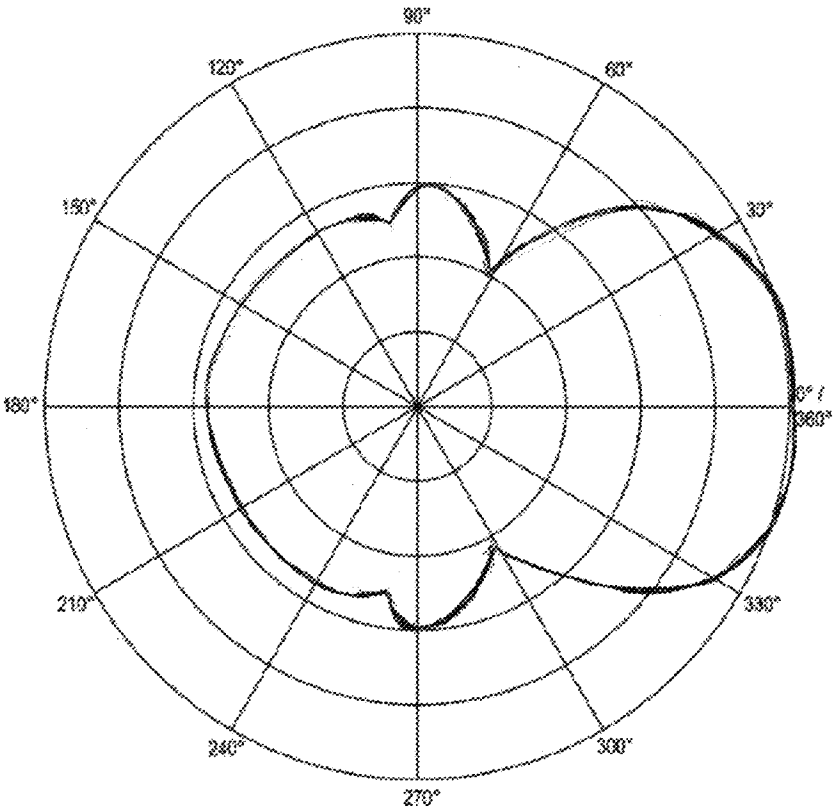
FIG. 24 shows vertical polar response of six microphones without the housing.

For the device presented here, the directionality for a sound that is propagating horizontally maintains 4 dB to 5 dB of directionality down to 2000 Hz, with about 5 dB of directionality at 4000 Hz. In comparison, FIG. 23 and FIG. 24 shows the horizontal and vertical polar responses if six microphones were used mounted on an utterly flat plane with the same spacing at 3600 Hz. The result is a very narrow polar pattern with many large side lobes. Even though using six microphones may result in greater directivity it is really not a usable beam since it is unlikely that the true talker will be located precisely at the direction from that direction.

Referring to the earlier two-microphone analysis, it was noted that the usefulness of delay and sum beams depended on whether the arrival of sound was broadside or end-fire.

$$f_b=1.5\times c/(2\times d)$$

$$f_e=1.5\times c/(4\times d)$$

where c is the speed of sound and d is the distance between microphones, and 1.5 is a factor for estimating the highest frequency where the beam is effective. In the case of the embodiment of the six microphone array, the distance between microphones is 69.85 millimeters. While a six microphone array has a much more complicated polar response, the formulas for the effective frequency ranges for broadside and end-fire arrays are a useful approximation for estimating the effectiveness of delay and sum beams. In this case the frequencies are:

$$f_b=3.69\text{ kHz}$$

$$f_e=1.85\text{ kHz}$$

To use the same number of microphones without the benefit of the domed housing would require bringing them much closer together. Bringing them closer together will cause problems with making effective beams at low frequencies. Low frequency beams need to have larger distance between microphones for either differential beams or delay and sum (additive) beams. Therefore, the use of the dome-shaped device with microphones ports positioned on the perimeter and very close to the surface of the table allow for good performance across a wider range of frequencies. Another way to view this benefit, is that it takes fewer microphones to make an effective array. Without the dome-shaped housing the microphones would have to be spaced about one half the distance of the embodiment described above. For similar performance, there would have to be almost twice as many microphones.

Figure 25:
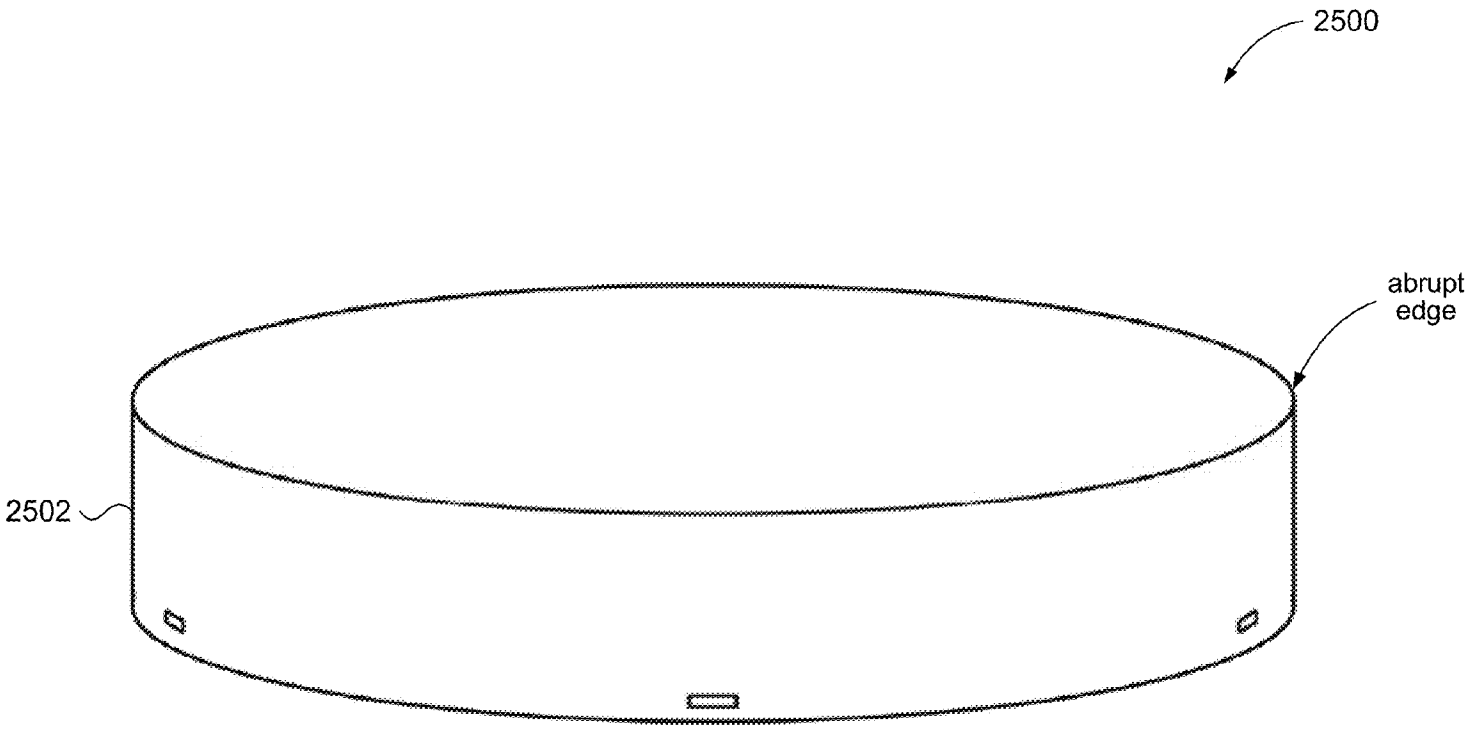
FIG. 25 shows example of a cylindrical shaped microphone array device.
Figure 26:
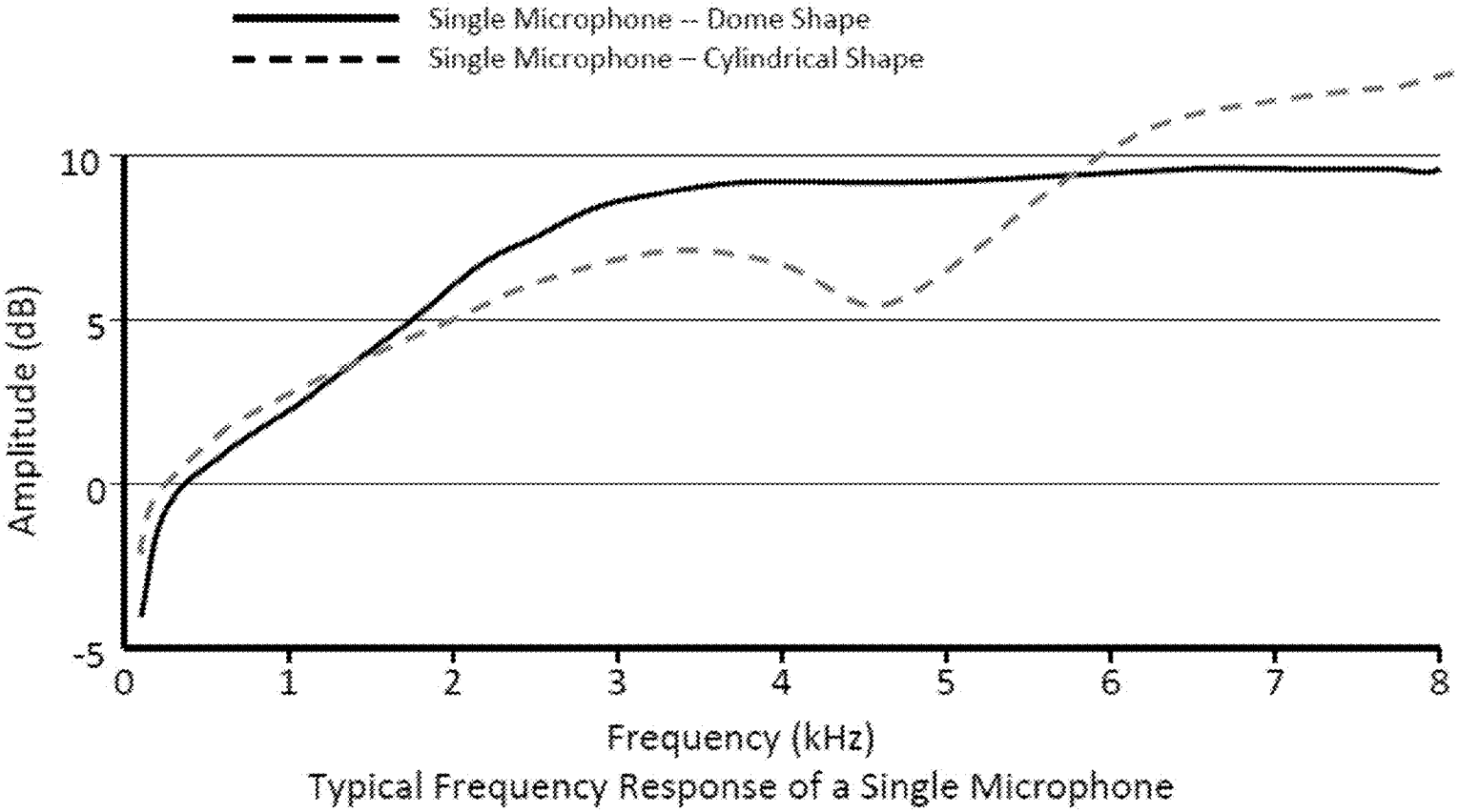
FIG. 26 shows example of the frequency response for a single microphone for a dome-shaped device and a cylindrical shaped device.

Dome Shape. Other formulas for the dome shape could work other than a circular segment. However, the cross sectional shape should not be a shape with abrupt transitions. As an extreme example, the shape of a housing 2502 of a device 2500 could be a short cylinder as shown in FIG. 25. The problem is that a cylinder has an abrupt edge that complicates the propagation of the sound wave to microphones that are on the other side of the device. This will cause the frequency response of individual microphones to have variation in their response depending on the direction that the sound arrives at the microphone. The dome shape creates a microphone response that gently transitions from low frequencies to high frequencies and creates the least disturbance possible for the waves to propagate around the device. If a cylindrical shape is used, the response will vary depending on the location of the talker's mouth relative to the device. FIG. 26, for example, shows a comparison of frequency responses that are typical for a dome shaped device and a cylindrical. It is fairly easy to equalize the response of the dome-shaped device, while a cylindrical device probably cannot be so easily equalized. Also, keep in mind that direction finding can be an important capability. A device with sharp edges, such as a cylinder will make it harder than a dome-shaped device to reliably detect the direction of sound because the response will have more variation from different angles of elevation of the talker's mouth relative to the device.

In regard to height of the dome, the height could be as high as the radius of the circle, but would generally be about on half of the radius. The dome shape provides several advantages: (1) at low frequencies, it is not an obstacle to sound so classic beamforming can be used at lower frequencies; (2) a way to pack electrical circuits and loudspeaker inside the housing; and (3) it creates directionality for high frequency sound for microphone pickup, and 3) it creates a baffle for the centrally located loudspeaker. For the loudspeaker, there is an advantage in keeping the dome as flat as possible near the loudspeaker. Practitioners of loudspeaker design call the array around the loudspeaker a baffle. In principle, the ideal baffle is a baffle that is flat and continues forever. In practice, the dome shape approximates an infinite baffle.

For the low frequency beams of the microphone array, it is better for the dome to be lower to create as little distortion as possible to the sound and to allow for utilizing all the microphones for delay and sum beams. For directivity for a single microphone, the dome must have some steepness near the edge of the perimeter of the device in order to create more sound pressure in the direction of sound. The lower the steep area the less directivity will be achieved.

The present disclosure teaches a height of approximately one half of the radius of the circle. The cross section of the shape of the dome can be identically the same shape as a circular segment. The shape of the dome can be interrupted by adornments, cosmetic features, buttons, or visual features. In some embodiments, the physical features may be small compared to about ¼ of the shortest wavelength of interest for sound that is captured by the microphones. In some embodiments, the highest frequency may be 7 kHz, where the quarter wavelength is 12.25 millimeters. So any features that have dimensions significantly less than one half of the quarter wavelength, or 6.125 millimeters, will not have a significant effect on the performance of the device.

Figure 27:
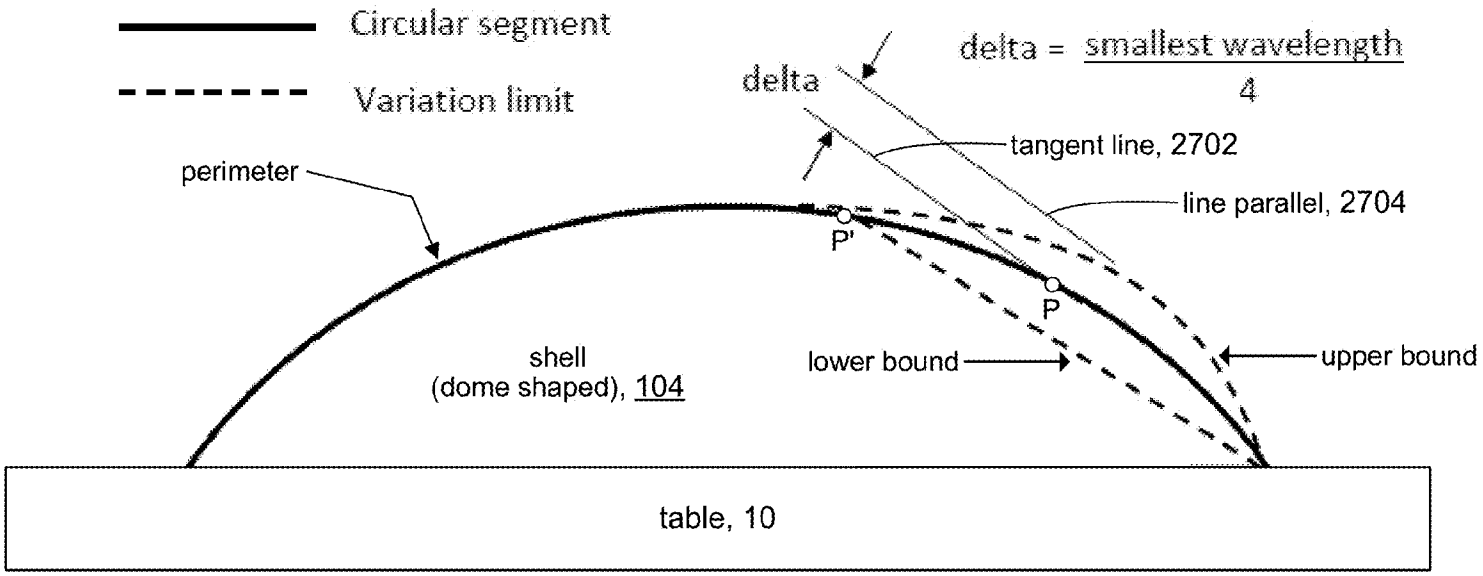
FIG. 27 shows examples of shapes that have progressively increasing slope.

A dome shape may have the same cross section as the shape of a circle, or it can have a different cross sectional profile. Like a circle, the formula for the cross section should have a shape that progressively has increasing slope as the measurement of the slope moves from the center to the perimeter. This restriction ensures that the shape is progressive and will minimize diffraction patterns. See FIG. 27 for illustrations of examples of progressive change in slope in accordance with the present disclosure. A tangent line 2702 may be subtended from a point P on the perimeter of the dome-shaped shell 104 that is tangent to the perimeter at point P. A line 2704 parallel to and spaced apart (by a distance delta) from the tangent line 2702 may serve to define an upper bound of the perimeter of the dome-shaped shell 104. A lower bound may be defined by a chord defined from the periphery to a point P' on the dome-shaped shell 104. In some embodiments, delta may be less than a quarter wavelength of a predetermined smallest wavelength (e.g., 7 kHz) to be captured by the microphones. The distance delta, therefore, represents a maximum dimensional variation in the cross section of the dome-shaped shell 104.

Spatial Filter Implementation. The following section describes an implementation of spatial filters, in accordance with the present disclosure, that encompass the response across the whole frequency spectrum. The spatial filters are the same thing as beamformers. In this description, the beams are discrete beams. This disclosure teaches that the beams are discrete beams. There may be a large collection of beams, but it is not continuously variable. Beams can be implemented in a number of different ways including frequency domain implementation. For simplicity, the description here is in the time domain.

Referring again to FIG. 22, as previously mentioned, the signal spectrum may be divided into overlapping subbands. In some embodiments for example, there may be four subbands 2202-2208 as shown in FIG. 22. The subbands have varying bandwidth with the high frequency subband 2202 being the largest subband. The lower subbands 2204-2208 may be progressively one half the bandwidth of the higher adjacent subband. In some embodiments, the subbands may be divided into additional subbands of smaller bandwidths. Smaller bandwidths only mean slightly greater delay and computations. For discussion purposes, the upper sideband 2202 is labeled as subband #4, the next lower sideband 2204 is labeled as subband #3, subband 2206 is labeled as subband #2 and subband 2208 is labeled as subband #1.

In some embodiments, the strategy that is taught is that the upper subband #4 will correspond to a single microphone. The next lower subband #3 may correspond to of one of the following: 1) a delay and sum array with coefficients that are larger on the side where sound is detected, or 2) a hybrid of delay and sum and differential techniques. For the purpose of illustration, we only consider the first case, the delay and sum array with weighting. If there are six microphones, then the delay and sum equation is:

$$y(k)=a0\times x0(t-T0)+a1\times x1(t-T1)+a2\times x2(t-T2)+a3\times x3(t-T3)+a4\times x4(t-T4)+a5\times x5(t-T5)$$

Figure 28:
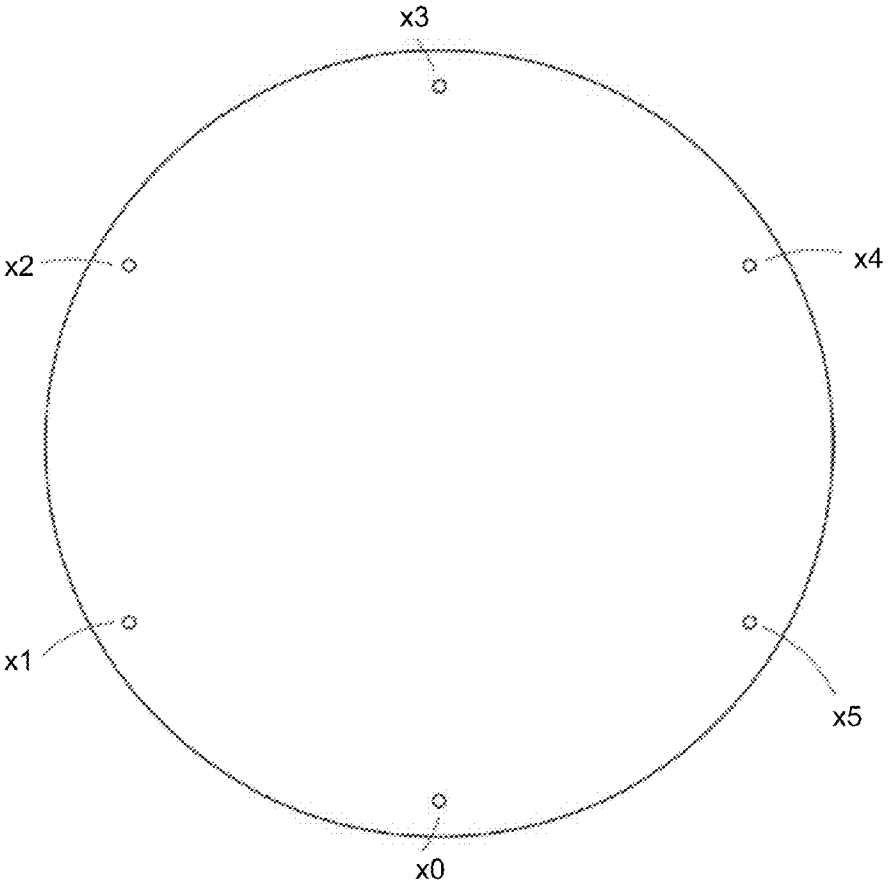
FIG. 28 shows the indexing of microphones for a six-microphone embodiment.

For a delay and sum array there are coefficients a0 through a5. These are weights that are all greater than 0. FIG. 28 shows the indexing of the microphones. The values x0, x1, etc., represent the sound pressure sensed by each microphone. The values T0, T1, etc., represent delays relative to a current time.

There will be a multitude of beams, with at least one beam for each possible direction. There can be several beams aiming in the same direction with different shaped lobes. Using several beams in the same direction would be useful to approximate null-steering to eliminate noise coming from a particular direction.

For subband #3, for example, the coefficients a0 through a5 may be weighted so that the coefficients associated with the direction of the sound are weighted with a larger coefficient than the microphones that are facing away from the sound. As an example, if the sound is coming from a direction between microphones x2 and x3 (e.g., as determined by a direction-finding algorithm), then the coefficients a2 and a3 will have the largest coefficients, while weights a1 and a4 will be less, and weights a0 and a5 will be even less or possibly zero. Merely to illustrate this point by example, for the case where the sound is coming from between x2 and x3, then the coefficients may be:

a0=0.0, a1=0.216, a2=0.284, a3=0.284, a4=0.216, a5=0.0.

Subband #3 covers the range between 1 kHz to 4 kHz. It crosses over with subband #2 at 1.5 kHz and crosses over with subband #4 at 3 kHz. The subbands are constructed with linear phase filters with the same group delay so that the filters merely need to be added together to form the output signal.

Figure 22A:
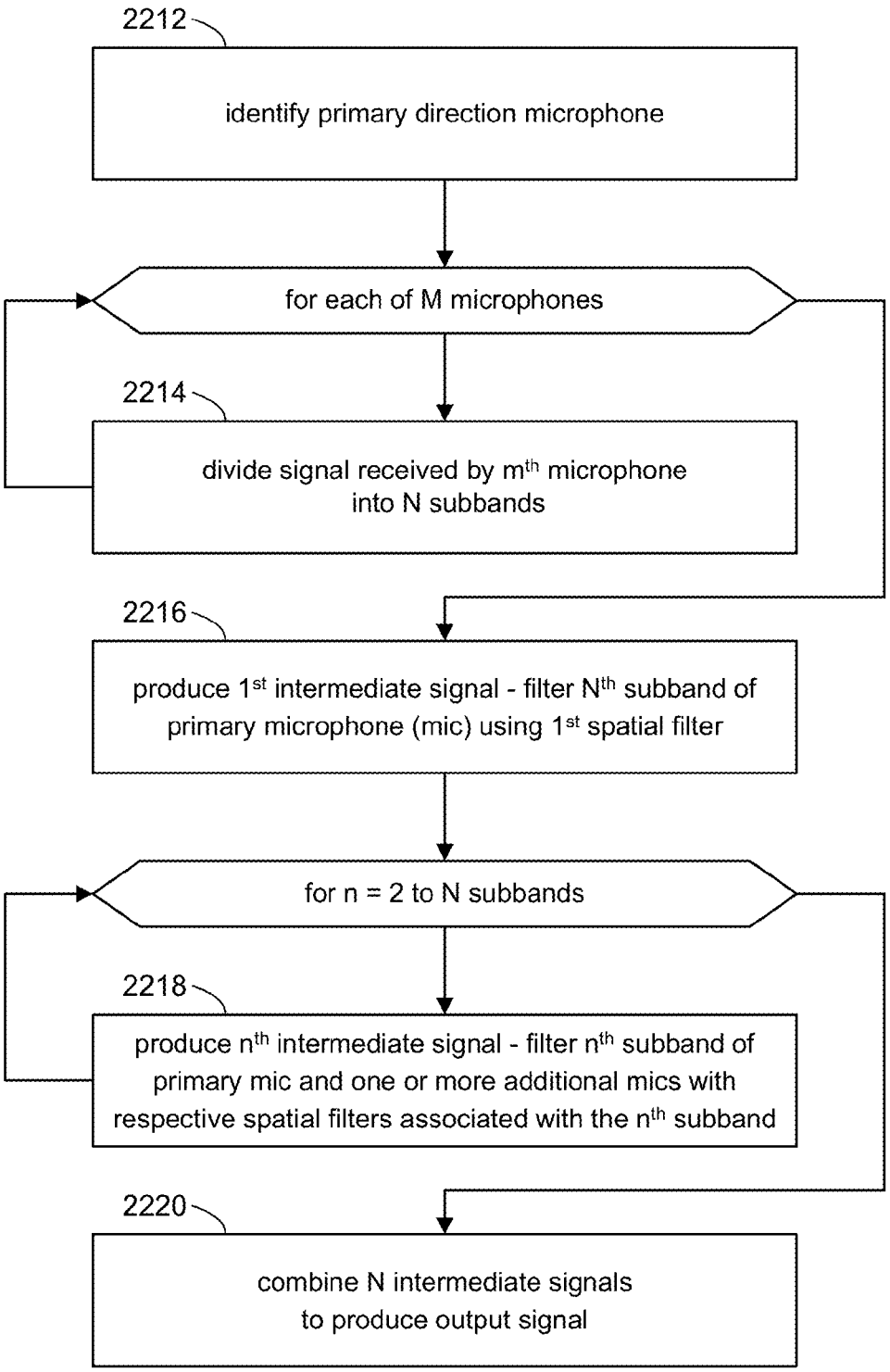
FIG. 22A shows processing of the overlapping subbands in accordance with an embodiment of the device.

FIG. 22A shows processing of subbands (as shown in FIG. 22, for example) in accordance with some embodiments of the present disclosure. In some embodiments, for example, the device 100 may include computer executable program code, which when executed by data processing components (e.g., device electronics 1202, FIG. 12), may cause the data processing components to perform processing in accordance with FIG. 22A.

At block 2212, the data processing components may identify from among M microphones (e.g., 112), a "primary direction" microphone (primary mic). The direction of the primary mic represents the direction of the sound source. In some embodiments, the primary mic may be determined by comparing the signal strength of the signals from each microphone; the microphone that outputs the greatest signal strength would be deemed the primary mic. In other embodiments, the primary mic may be determined based on signals from two more or microphones.

At block 2214, the data processing components may divide each signal received from each of the M microphones into N subbands; e.g., the signal from microphone #1 may be divided into N subbands, the signal from microphone #2 may be divided into N subbands, and so on. In some embodiments, the subbands may overlap. FIG. 22, for example, shows N=4 overlapping subbands, where the $1^{st}$ subband spans the lowest frequency range and the $4^{th}$ subband spans the highest frequency range.

At block 2216, the data processing components may produce a first of N intermediate signals (beams) to form a resulting beam (beamforming) that represents the sound source. In some embodiments, the data processing components may simply take the $N^{th}$ subband of the signal from the primary mic to generate the first intermediate signal (beam). For frequencies in the highest ($N^{th}$) subband, the primary mic may utilize the dome shape to create higher pressure for sound arriving substantially orthogonal to the surface of the edge of the dome and thereby simply use the single primary microphone to make the first intermediate signal (beam).

At block 2218, the data processing components may generate additional intermediate signals for each of the remaining subbands. In some embodiments, each of the remaining subbands from the $2^{nd}$ subband to the $N^{th}$ subband of the primary mic signal and additional microphone signals may be filtered with a respective spatial filter (e.g., a spatial filter designed for that subband) to produce $2^{nd}$ to $N^{th}$ filtered subband signals. After a beam is produced by each spatial filter for each subband (the intermediate signals), then all the N intermediate signals may be summed to produce a single output signal that is composed of different beams utilized in the N subbands.

In some embodiments, the beams may be formed depending the subband. Merely to illustrate this point, referring to the configuration shown in FIG. 22, for example, a differential beam may be formed for the $1^{st}$ subband (e.g., frequencies below 1000 HZ). As another example, for frequencies in the second subband (between 500 HZ and 2000 HZ), the beam may be formed using a delay and sum beam having non-zero positive coefficients.

At block 2220, the data processing components may combine the N intermediate signals (beams) produced at block 2218 to form a resulting beam (output signal). The output signal may then be transmitted to a device to drive a loudspeaker in the device, thus reproducing the sound.

Figure 29:
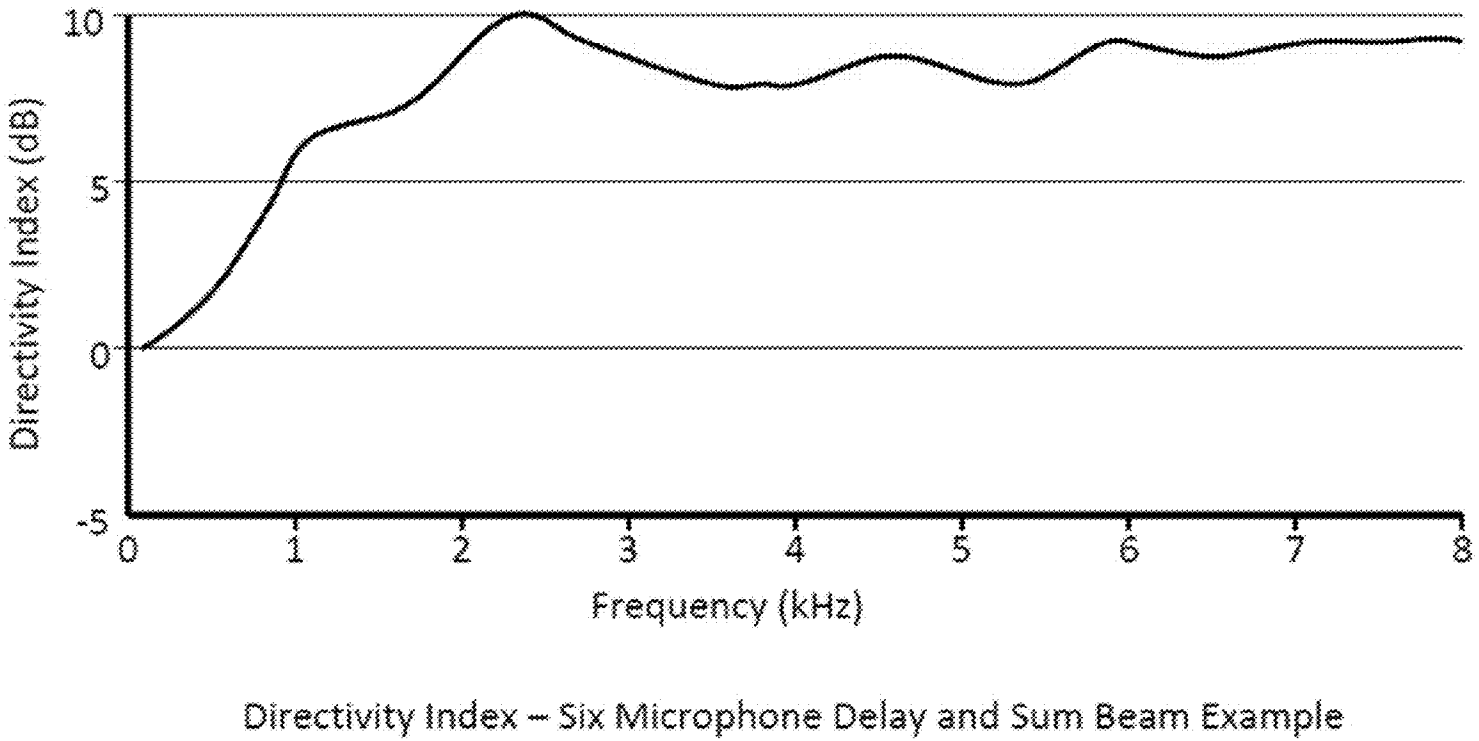
FIG. 29 shows the Directivity Index of the spatial filter example for a six-microphone delay and sum beam.

FIG. 29 shows the Directivity Index of the spatial filter for the coefficients subband #3 used above. In this instance, all six coefficients are all equal to ⅙. Note that the directivity is very good, approximately 9 dB through most of the range between 1 kHz to 4 kHz.

Figure 30:
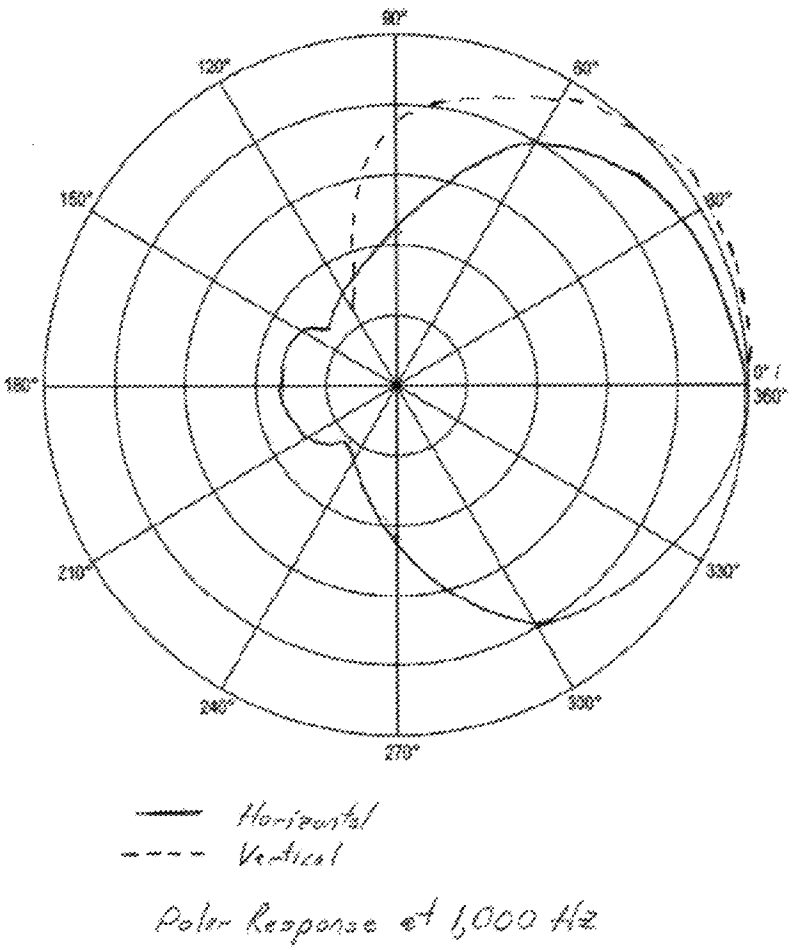
FIG. 30 shows a typical polar plot for a hybrid differential beam.
Figure 31:
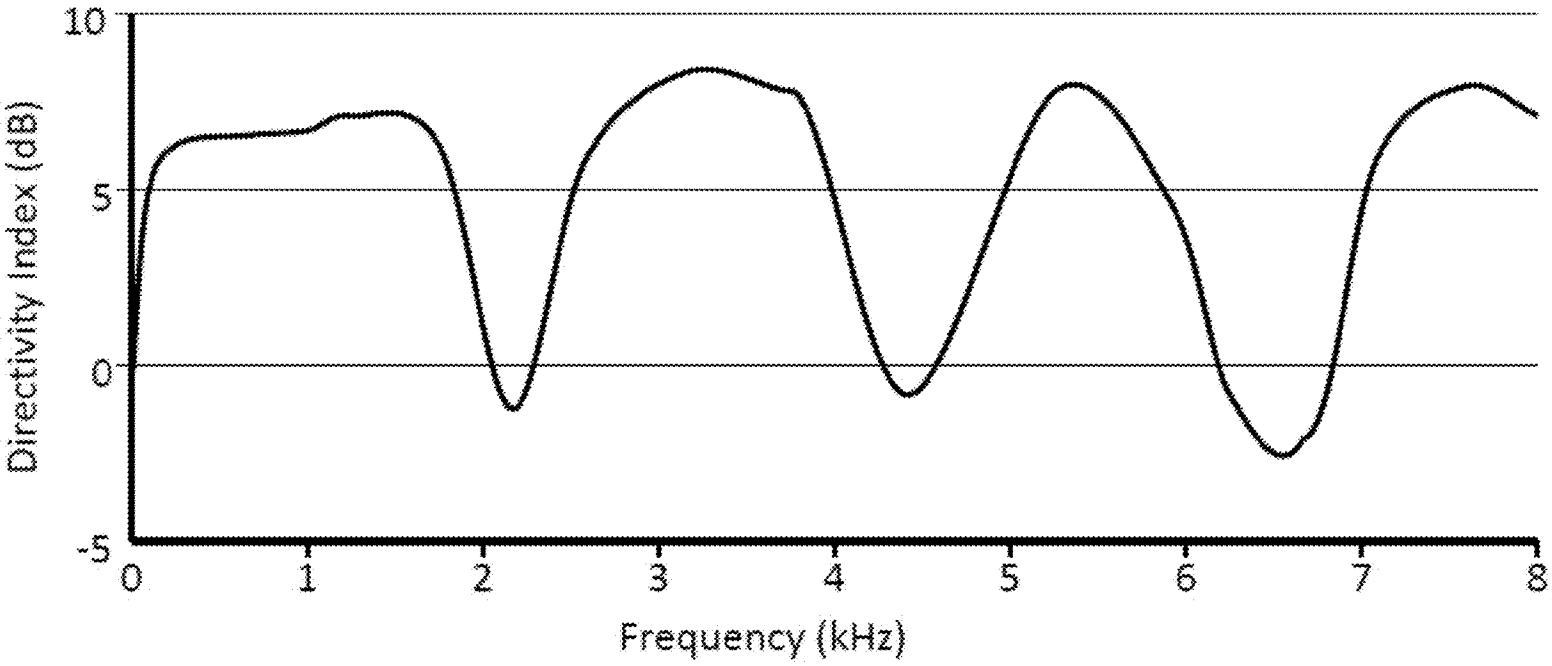
FIG. 31 shows a typical plot of Directivity Index vs. frequency.

For subband #2, it is most typical that the beams formed for this subband will be a hybrid of differential beams and delay and sum beams. A typical horizontal polar response plot at 1000 Hz is shown in FIG. 30 and the Directivity Index of the spatial filter is shown in FIG. 31. This subband is crucial because it is mostly centered at 1 kHz where most speech energy is occurs. This subband spans between 500 Hz and 2000 Hz. In this figure, the acoustic response is not taken into account, though it improves the overall directivity index by about 1 dB across the range of interest.

Subband #1 covers the range between 0 Hz and 750 Hz. The beams in this subband may be similar to subband #2, but it will be designed to minimize self noise from the microphones. For low frequencies the compensation filter will need to add a lot of gain at the low frequencies. This raises noise that is caused by self-noise, because the noise is uncorrelated between the microphones. At the low end of human speech, about 100 Hz, the compensation filter may need to add 15 dB of gain, so if the microphone self-noise is substantial then the spatial filter (beam) needs to be designed to get the best directivity, but minimize noise.

It would be understood by practitioners in the art of beam design that there are a multitude of ways to design the beams. For a device in accordance with the present disclosure, the beam design may follow this order in some embodiments:

Highest band—a single microphone (primary direction microphone)

Next lower band—a delay and sum beam

Lowest bands—hybrid differential beams

Figure 32:
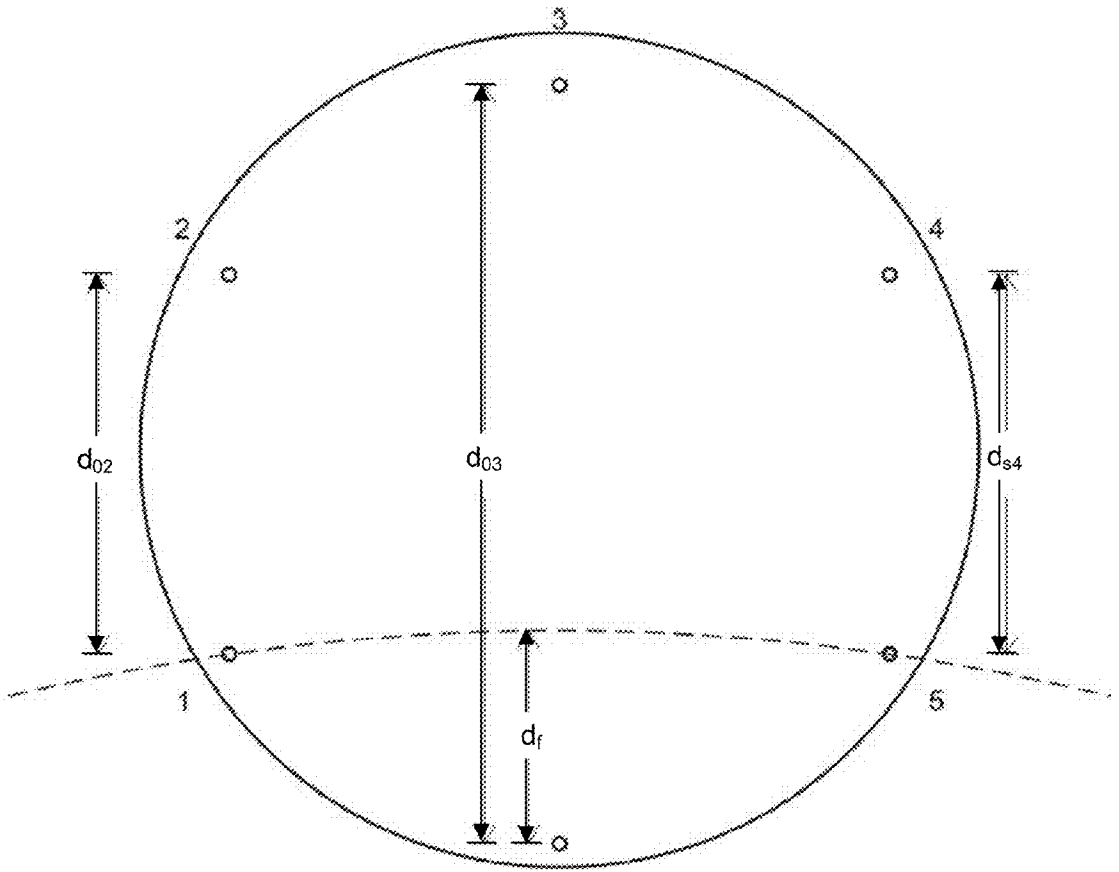
FIG. 32 shows the distance measurements that are used to design a hybrid differential array.

An example of a hybrid differential beam would be to take pairs of microphones and take the difference between each microphone element within each pair. Within each pair one microphone is the front microphone and one microphone is the rear microphone. The front microphones would each be delayed the right amount so that the resulting signal from the front microphones is aligned. Then for each pair, the rear microphone is delayed relative to the front microphone so that the difference in delay would be between 0 delay (for a bidirectional beam) and delay d/c (where d is the distance between pairs of microphones and c is the speed of sound). This example is shown in FIG. 32. In this example the sound is coming from a source that is propagating toward microphone x0. Using the microphone indexing of FIG. 28, the resulting equation for the hybrid differential beam would be the same equation as was used above for delay and sum beams except that the coefficients may be positive or negative, and the delay for each of the rear microphones in each pair is selected to get the best directivity and least self noise:

$$y(k)=a0\times x0(t-T0)+a1\times x1(t-T1)+a2\times x2(t-T2)+a3\times x3(t-T3)+a4\times x4(t-T4)+a5\times x5(t-T5)$$

To make each pair a hypercardioid beam then the relative delay between the front and rear microphone of each pair would be d/(3×c). The delay selection for the front microphones, x0, x1, and x5 is selected so that x0 aligns with x1 and x5 using the delay associated with the propagation delay between the front most microphone and the two microphones that are further away from the source. This distance is called $d_f$ in the FIG. 32. The coefficients are determined based on the fact that there is a nominal degree of attenuation simply due to the dome shaped of the device. The attenuation is less for low frequencies than for higher frequencies, so the attenuation would typically be selected to match the physical attenuation. In addition, the rear microphones are slightly farther away from the source. Consequently, there will be a degree of natural attenuation simply because they are farther away. The attenuation will simply be the distance from the source to the front microphone divided by the distance to the rear microphone. If the distance between the two microphones is 140 millimeters and the talker source is 1 meter away from the front microphone, then the attenuation due to distance is 1000/(1000+140) or 0.877. If we presume that the physical attenuation due to the dome shaped obstacle is 0.95, then the rear coefficient would be 0.877×0.95 or 0.833. Yet another advantage of the dome shape is that the physical attenuation due to the dome shape is fairly consistent within a subband. For the side microphones the attenuation due to distance is less 1000/(1000+70) or 0.935. The attenuation due to the dome-shaped obstacle is nearly insignificant for the side microphones for sound arriving directly at microphone x0.

It is implicit that results of each of the 3 pairs of microphones are given equal weight and added together just as if each of the pairs is treated as a delay and sum microphone element. Hence, this is a hybrid of first-order gradient beams and delay and sum beams.

The resulting delays and attentions of the equation, restated:

$$y(k)=a0\times x0(t-T0)+a1\times x1(t-T1)+a2\times x2(t-T2)+a3\times x3(t-T3)+a4\times x4(t-T4)+a5\times x5(t-T5),$$

where a0=a1=a5=1.0 a3=0.877 a4=a2=0.935

$T0=c/d_f$

T1=T5=0.0

T3=T0+c /(3×d03)

T2=T4=c/(3×d12)

Substituting these values into the above equation will make a hybrid differential beam. This hybrid beam will be slightly narrower from side to side and slightly more directive vertically than if the beam were merely made from a single pair of microphones.

The present disclosure teaches that the number of microphones can be minimized by using a dome shape while allowing the microphones to be spread further apart. The shape of the dome can allow for the use of a single microphone to pick up high frequency sound in the direction that the microphone is facing.

Alternatively, the same concept can be used to achieve even greater performance by using more microphones placed around the perimeter of the device at a low height from the table. If the microphones are placed closer together then it is possible to use more than one microphone. The first choice for the highest subband would be to use 2 or 3 microphones organized as a delay and sum array. This will increase the Directivity Index by approximately 3-4 dB. Another advantage of using more microphones will lower the self-noise problem for the subband #1 where hybrid differential beams are used.

Regardless of the number of microphones the spatial filter strategy remains that the highest frequency subband uses a single microphone or two or three microphones as a delay and sum beam, then recruit more microphones for the next lower subband, and then use hybrid differential beams for the lowest frequencies.

What is claimed is:

1. A sound sensing device comprising:

a housing having a dome-shaped shell and a baseplate to house electronic components of the sound sensing device, the housing having a rotationally symmetric perimeter, the dome-shaped shell having an arcuate cross section characterized by tangent lines that monotonically increase in slope from a top of the dome-shaped shell toward a bottom of the dome-shaped shell;

at least six sound ports formed between an interior volume of the housing and an exterior surrounding of the housing, and disposed symmetrically and peripherally about the perimeter of the housing, the sound ports located at most 1 cm above a support surface; and at least six microphones contained within the housing, the microphones disposed symmetrically and peripherally about the perimeter of the housing, each microphone arranged proximate a respective sound port to receive an acoustic signal via the respective sound port, wherein microphone signals from the microphones are combined together to produce an output signal representative of a sound source for any direction of the sound source, wherein each of the microphone signals is converted into overlapping subband signals, wherein a plurality of subband beams are generated using subband signals from each of the microphone signals, the plurality of subband beams including:

a plurality of first subband beams, each of which is hybrid of a delay and sum beam and a differential beam that is generated using subband signals, from the microphone signals of all the microphones, that are in a first frequency range;

a second subband beam that is a delay and sum beam comprising non-zero positive coefficients generated using subband signals, from the microphone signals of one or more of the microphones, that are in a second frequency range, and a third subband beam comprising a subband signal from the microphone signal of a primary direction microphone whose location on the housing is representative of a direction of the sound source, wherein the dome shape creates a higher pressure for sound, arriving at the primary direction microphone, that is substantially orthogonal to the support surface at an edge of the dome-shaped shell, wherein the plurality of subband beams are combined to produce the output signal.

2. The device of claim 1, further comprising an annular pad disposed peripherally about a perimeter of a bottom surface of the baseplate to support the housing on the support surface.

3. The device of claim 1, wherein a height of the dome-shaped shell is less than or equal to a distance from a center of the dome-shaped shell to a periphery thereof.

4. The device of claim 1, further comprising surface features on the dome-shaped shell that have dimensions that are less than a quarter wavelength of a predetermined smallest wavelength to be captured by the microphones.

5. The device of claim 4, wherein the predetermined smallest wavelength corresponds to 7 kHz (49 millimeters wavelength).

6. The device of claim 4, wherein the surface features include one or more of surface adornments formed on a surface of the dome-shaped shell and buttons to operate the sound sensing device.

7. The device of claim 1, wherein the perimeter of the housing has a shape of a circle or a regular polygon.

8. The device of claim 1, wherein the sound ports are formed through the dome-shape shell and open through an upper surface of the dome-shaped shell.

9. The device of claim 1, wherein the dome-shaped shell comprises a plurality of posts that extend toward and contact a printed circuit board (PCB), each post having a hollow interior, a first end aligned with one of the microphones, and a second end that terminates at one of the sound ports.

10. The device of claim 9, wherein the plurality of microphones are disposed on the PCB.

11. The device of claim 1, wherein the sound ports are formed through the baseplate and open through a bottom surface of the baseplate.

12. The device of claim 11, where the sound ports have an elastomeric pad to impede sound coming from under the device from entering into the microphone port.

13. The device of claim 1, further comprising a speaker that is centrally disposed at the top of the dome-shaped shell.

14. The device of claim 13, wherein the microphones are equidistant from the speaker and symmetrically disposed about the speaker.

15. The device of claim 1, wherein a height of the device is at least 20 millimeters.

16. The device of claim 1, wherein the arcuate cross section is defined as a circular segment having a height of 3.3 centimeters, a termination of the arcuate cross section is no higher than 1 centimeter above a bottom of the device, and deviations of the arcuate cross section do not exceed 1.225 centimeters.

17. The device of claim 1, wherein a diameter of the device is greater than 10 centimeters.

18. The device of claim 1, wherein a diameter of the device is no more than 20 centimeters.

19. The device of claim 1, wherein a diameter of the device is greater than 12 centimeters and less than 15.2 centimeters.

20. A sound sensing device comprising:

a housing having a dome-shaped shell and a baseplate to house electronic components of the sound sensing device, the housing having a perimeter in a shape of a circle or a regular polygon with at least six sides, the dome-shaped shell having a cross section characterized by a substantially constant change in slope, the housing having a diameter of about 15 centimeters and a height of about 3.3 centimeters;

a loudspeaker centrally disposed at a top of the dome-shaped shell;

at least six sound ports formed between an interior volume of the housing and an exterior surrounding of the housing, and disposed symmetrically and peripherally about the perimeter of the housing, the sound ports located at most 1 centimeter above a support surface as measured from respective centers thereof; and at least six microphones contained within the housing, the microphones disposed symmetrically and peripherally about the perimeter of the housing, each microphone connected to a respective sound port, wherein microphone signals from the microphones are combined together to produce an output signal representative of a sound source for any direction of the sound source, wherein each of the microphone signals is converted into overlapping subband signals, wherein a plurality of subband beams are generated using subband signals from each of the microphone signals, the plurality of subband beams including:

a plurality of first subband beams, each of which is hybrid of a delay and sum beam and a differential beam that is generated using subband signals, from the microphone signals of all the microphones, that are in a first frequency range;

a second subband beam that is a delay and sum beam comprising non-zero positive coefficients generated using subband signals, from the microphone signals of one or more of the microphones, that are in a second frequency range, and a third subband beam comprising a subband signal from the microphone signal of a primary direction microphone whose location on the housing is representative of a direction of the sound source, wherein the dome shape creates a higher pressure for sound, arriving at the primary direction microphone, that is substantially orthogonal to the support surface at an edge of the dome-shaped shell, wherein the plurality of subband beams are combined to produce the output signal.

21. The device of claim 20, further comprising an annular pad disposed peripherally about a perimeter of a bottom surface of the baseplate to support the housing on the support surface.

22. The device of claim 20, wherein a height of the dome-shaped shell is less than or equal to a distance from a center of the dome-shaped shell to a periphery thereof.

23. The device of claim 20, further comprising surface features on the dome-shaped shell that have dimensions less than a quarter wavelength of a predetermined lowest wavelength to be captured by the microphones.

24. The device of claim 1, wherein the microphone signals of all the microphones are used to identify the primary direction microphone.

25. The device of claim 1, wherein the plurality of subband beams further includes one or more additional second subband beams.

26. The device of claim 25, wherein the plurality of subband beams further includes one or more additional third subband beams.

27. The device of claim 1, further comprising additional subband beams, each additional subband beam being a delay and sum beam comprising non-zero positive coefficients generated using subband signals from the microphone signals of one or more of the microphones.

28. The device of claim 1, wherein the first frequency range is between 0 Hz to 1000 Hz, wherein the second frequency range is between 1000 Hz and 4000 Hz.

29. The device of claim 28, wherein the subband signal that comprises the third subband beam comprise a third frequency range between 4000 Hz and 8000 Hz.

30. The device of claim 29, wherein the first frequency range overlaps the second frequency range in a range between 1000 Hz and 2000 Hz, wherein the second frequency range overlaps the third frequency range in a range between 2000 Hz and 4000 Hz.

* * * * *